US011680353B2

(12) United States Patent
Nam et al.

(10) Patent No.: US 11,680,353 B2
(45) Date of Patent: Jun. 20, 2023

(54) WASHING MACHINE AND CONTROL METHOD THEREOF

(71) Applicant: SAMSUNG ELECTRONICS CO., LTD., Suwon-si (KR)

(72) Inventors: Yeon-Young Nam, Goyang-si (KR); Gi Hoon Ko, Seoul (KR); Ji Hyeoung Lee, Seoul (KR); Simon Ireland, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 654 days.

(21) Appl. No.: 16/475,934

(22) PCT Filed: Nov. 13, 2017

(86) PCT No.: PCT/KR2017/012776
§ 371 (c)(1),
(2) Date: Jul. 3, 2019

(87) PCT Pub. No.: WO2018/128260
PCT Pub. Date: Jul. 12, 2018

(65) Prior Publication Data

US 2019/0345660 A1 Nov. 14, 2019

(30) Foreign Application Priority Data

Jan. 3, 2017 (KR) ..... 10-2017-0000773

(51) Int. Cl.
*D06F 39/02* (2006.01)
*D06F 103/04* (2020.01)
(Continued)

(52) U.S. Cl.
CPC ..... *D06F 39/022* (2013.01); *D06F 33/37* (2020.02); *D06F 39/085* (2013.01);
(Continued)

(58) Field of Classification Search
CPC ..... D06F 39/02; D06F 39/022; D06F 39/028
See application file for complete search history.

(56) References Cited

U.S. PATENT DOCUMENTS 2,812,720 A * 11/1957 Ellis ..... F04B 53/00 417/415
2004/0000177 A1* 1/2004 Maeng ..... D06F 39/02 68/17 R
(Continued)

FOREIGN PATENT DOCUMENTS

CN 101748578 6/2010
DE 102007050920 12/2008
(Continued)

OTHER PUBLICATIONS

Machine translation of KR0123413B1, dated Nov. 1997. (Year: 1997).*
(Continued)

*Primary Examiner* — Michael E Barr
*Assistant Examiner* — Kevin G Lee
(74) *Attorney, Agent, or Firm* — Staas & Halsey LLP

(57) ABSTRACT

A washing machine and a control method thereof are provided. More particularly, a washing machine of supplying a detergent automatically to a detergent mixing tub using a detachable detergent supply container, or of supplying a softening agent automatically to a softening agent mixing tub using a detachable softening agent supply container, and a method of controlling the washing machine are disclosed. Some of the disclosed embodiments provide a washing machine of supplying a detergent automatically to a washing tub using a detergent supply unit with a detergent supply container, and of supplying a softening agent automatically to the washing tub using a softening agent supply unit with
(Continued)

a softening agent supply container, and a method of controlling the washing machine.

11 Claims, 22 Drawing Sheets

(51) Int. Cl.

| | |
|---|---|
| *D06F 103/18* | (2020.01) |
| *D06F 103/40* | (2020.01) |
| *D06F 105/42* | (2020.01) |
| *D06F 105/58* | (2020.01) |
| *D06F 101/20* | (2020.01) |
| *D06F 33/37* | (2020.01) |
| *D06F 39/08* | (2006.01) |

(52) U.S. Cl.
CPC ..... *D06F 2101/20* (2020.02); *D06F 2103/04* (2020.02); *D06F 2103/18* (2020.02); *D06F 2103/40* (2020.02); *D06F 2105/42* (2020.02); *D06F 2105/58* (2020.02)

(56) References Cited

U.S. PATENT DOCUMENTS

| | | | | |
|---|---|---|---|---|
| 2008/0251537 | A1* | 10/2008 | Kuo | B05B 11/306 222/321.9 |
| 2009/0100881 | A1 | 4/2009 | Dahlke | |

FOREIGN PATENT DOCUMENTS

| | | | | |
|---|---|---|---|---|
| EP | 2196574 | | 6/2010 | |
| EP | 2405052 | | 1/2012 | |
| JP | 6-105989 | | 4/1994 | |
| KR | 0123413 | | 2/1996 | |
| KR | 10-2007-0090399 | | 9/2007 | |
| KR | 10-1103109 | | 1/2012 | |
| KR | 10-1490168 | | 2/2015 | |
| WO | WO-2012001079 | A1 * | 1/2012 | B05B 11/0037 |

OTHER PUBLICATIONS

Machine translation of KR 101490168 B1, dated Feb. 2015. (Year: 2015).*
Written Opinion of the International Searching Authority dated Mar. 5, 2018 in corresponding International Patent Application No. PCT/KR2017/012776.
International Search Report dated Mar. 5, 2018 in corresponding International Patent Application No. PCT/KR2017/012776.
Extended European Search Report dated Jan. 23, 2020 in European Patent Application No. 17890390.2.
Partial European Search Report dated Oct. 18, 2019 in European Patent Application 17890390.2.
Chinese Office Action dated Mar. 18, 2021 in Chinese Patent Application No. 201780087853.5.
European Communication dated Mar. 22, 2021 in European Patent Application No. 17890390.2.
Notification of Office Action Issued by Intellectual Property of India for India Application No. 201917031133 dated Jun. 15, 2021.
Office Action dated Mar. 13, 2023 in Australian Patent Application No. 2017390514 (4 pages).

* cited by examiner

WASHING MACHINE AND CONTROL METHOD THEREOF

CROSS-REFERENCE TO RELATED APPLICATIONS

This application is a U.S. National Stage Application which claims the benefit under 35 U.S.C. § 371 of International Patent Application No. PCT/KR2017/012776 filed on Nov. 13, 2017, which claims foreign priority benefit under 35 U.S.C. § 119 of Korean Patent Application No. 10-2017-0000773 filed on Jan. 3, 2017 in the Korean Intellectual Property Office, the contents of both of which are incorporated herein by reference.

TECHNICAL FIELD

The present disclosure relates to a washing machine and a control method thereof, and more particularly, to a washing machine of supplying a detergent automatically to a washing tub using a detachable detergent supply container, and a method of controlling the washing machine.

BACKGROUND ART

A washing machine is an electronic apparatus for washing laundry including clothes, bedding, towels, or other textile goods using a detergent or a cleaner. The washing machine includes a washing tub to accommodate laundry and washing water, and performs washing by a rotation of the washing tub through a motor and a relative motion of the laundry against the washing tub.

Washing machines are classified into: a front loading type washing machine that rotates a washing tub disposed in parallel (or inclined) to the bottom in a clockwise or counterclockwise direction on a rotating shaft to wash laundry through a relative motion of the laundry against the inner surface of the washing tub; and a top loading type washing machine that rotates a washing tub disposed vertically to the bottom and including a pulsator in a clockwise or counterclockwise direction on a rotating shaft to wash laundry using water current generated by the pulsator.

In the washing machine, a detergent supply unit (or a softening agent supply unit) is installed to mix washing water with a detergent (or a softening agent) and to supply the mixed water to the inside of the washing tub.

DISCLOSURE

Technical Problem

The present disclosure is directed to providing a detergent supply unit (or a softening agent supply unit) of a washing machine, capable of measuring a residual amount of detergent (or a residual amount of softening agent) and/or capable of being easily cleaned.

Technical Solution

One aspect of the present disclosure provides a detergent supply unit comprising a housing, a detergent supply container detachably installed in an accommodating portion of the housing, and accommodating a detergent, a detergent mixing tub in which a part of the detergent is mixed with washing water, a pump configured to supply the part of the detergent from the detergent supply tub to the detergent mixing tub and a motor configured to transfer a driving force for driving the pump, wherein the pump comprises a pump handle performing a reciprocating motion by the driving force, and a detergent discharging opening for discharging a part of the detergent is formed at one end of the pump handle.

The pump may further comprise a detergent suction tube configured to suck a part of the detergent from the detergent supply container, and the detergent suction tube may be located in the inside of the detergent supply container.

The pump handle may be coupled with the detergent suction tube, and disposed outside the detergent supply container.

The pump handle may be rotatable with respect to the detergent supply container.

The pump further may comprise a pump driving shaft receiving the driving force from the motor, and a part of the pump driving shaft may be exposed to the outside of the detergent supply container.

The motor further may comprise a driving shaft transferring the driving force through a belt, and a driven shaft receiving the driving force through the belt, wherein the driving force is transferred to the pump driving shaft through the driven shaft.

A part of the driven shaft may be exposed to the outside, and the part of the driven shaft comprises a connector guide connected to the pump driving shaft.

The detergent mixing tub may receive washing water from a water supply unit.

Detergent mixed water mixed in the detergent mixing tub may be discharged by a mixed water hose connected to a bottom of the detergent mixing tub.

The detergent mixed water discharged through the mixed water hose may be discharged to the washing tub through a detergent case.

The detergent supply unit may further comprise a protrusion formed in the accommodating portion of the housing, a catching portion formed in the detergent supply container to correspond to the protrusion, and a release button, wherein when the release button is pressed, the protrusion is spaced apart from the protrusion.

A washing machine according to another embodiment of the present disclosure includes a main body having an opening in the upper portion, a door opening or closing the opening of the main body, a washing tub installed in the inside of the main body, a detergent supply container storing detergent, a detergent supply housing having an accommodating portion accommodating the detergent supply container, a detergent mixing tub positioned at one side of the accommodating portion, a first pump configured to supply a part of the detergent stored in the detergent supply container to the detergent mixing tub, and a first motor configured to provide a driving force for operating the first pump, wherein the first pump includes a pump handle reciprocating by the driving force, and at one end of the pump handle, a detergent outlet is provided to discharge a part of the detergent.

The first motor of the detergent supply unit may operate according to an electrical signal received from a processor.

The washing machine may further comprise a water supply unit for supplying water to the detergent mixing tub and a mixed water hose providing a path through which a part of the detergent supplied to the detergent mixing tub is supplied to the washing tub together with the water.

The washing machine may further comprise a softening agent supply container storing a softening agent, a softening agent supply housing having an accommodating portion accommodating the softening agent supply container, a softening agent mixing tub positioned at one side of the accommodating portion, a second pump configured to supply a part of the softening agent stored in the softening agent supply container to the softening agent mixing tub, and a second motor configured to provide a driving force for operating the second pump.

The detergent supply housing and the softening agent supply housing may be positioned at both sides of the washing tub.

Another aspect of the present disclosure provides a washing machine comprising a main body having an opening in the top, a door configured to open or close the opening of the main body, a washing tub disposed in the inside of the main body, and accommodating laundry, a supply assembly disposed in an upper portion of the main body, and configured to supply a detergent, a softening agent, and washing water to the washing tub using a plurality of pumps respectively driven by a plurality of driving forces transferred from a plurality of motors, an input device configured to receive a selection of a washing course, and a controller configured to control the supply assembly and the input device, wherein the controller controls the supply assembly to drive the motors, in correspondence to detection of closing of the door, and an amount of the detergent, an amount of the fabric softener, and an amount of washing water, calculated according to a weight of the laundry calculated according to the selected washing course, to form detergent mixed water and softening agent mixed water by automatic pumping and to supply the detergent mixed water and the softening agent mixed water to the washing tub.

The washing machine may further comprise a sensor configured to detect opening/closing of the door, wherein the controller detects closing of the door using the sensor.

The door may comprise a pump handle accommodating portion located in a bottom of the door, and configured to prevent the door from interfering with a handle of each pump when the door is closed.

The detergent accommodated in the detergent supply container may be supplied to one of the detergent mixing tub and the washing tub by manual pumping.

Advantageous Effects

There are provided a washing machine having a detergent supply container that can be easily detached from a detergent supply unit, and a method of controlling the washing machine.

There are provided a washing machine having a softening agent supply container that can be easily detached from a softening agent supply unit, and a method of controlling the washing machine.

There are provided a washing machine capable of intuitively recognizing a residual amount of detergent remaining in a detergent supply container installed in a detergent supply unit, and a method of controlling the washing machine.

There are provided a washing machine capable of intuitively recognizing a residual amount of softening agent remaining in a softening agent supply container installed in a softening agent supply unit, and a method of controlling the washing machine.

There are provided a washing machine in which a detergent supply container installed in a detergent supply unit is disposed at a short distance from a first mixing tub for mixing a detergent with washing water, and a method of controlling the washing machine.

There are provided a washing machine in which a softening agent supply container installed in a softening agent supply unit is disposed at a short distance from a second mixing tub for mixing a softening agent with washing water, and a method of controlling the washing machine.

There are provided a washing machine of supplying a detergent automatically from a detergent pump located in the inside of a detergent supply container installed in a detergent supply unit to a detergent mixing tub by a driving force transferred from a motor, and a method of controlling the washing machine.

There are provided a washing machine of supplying a softening agent automatically from a softening agent pump located in the inside of a softening agent supply container installed in a softening agent supply unit to a softening agent mixing tub by a driving force transferred from a motor, and a method of controlling the washing machine.

According to various embodiments of the present disclosure, there are provided a washing machine having a detergent supply container (or a softening agent supply container) that can be easily detached from a detergent supply unit (or a softening agent supply unit), and a method of controlling the washing machine.

MODES OF THE INVENTION

Figure 1A:
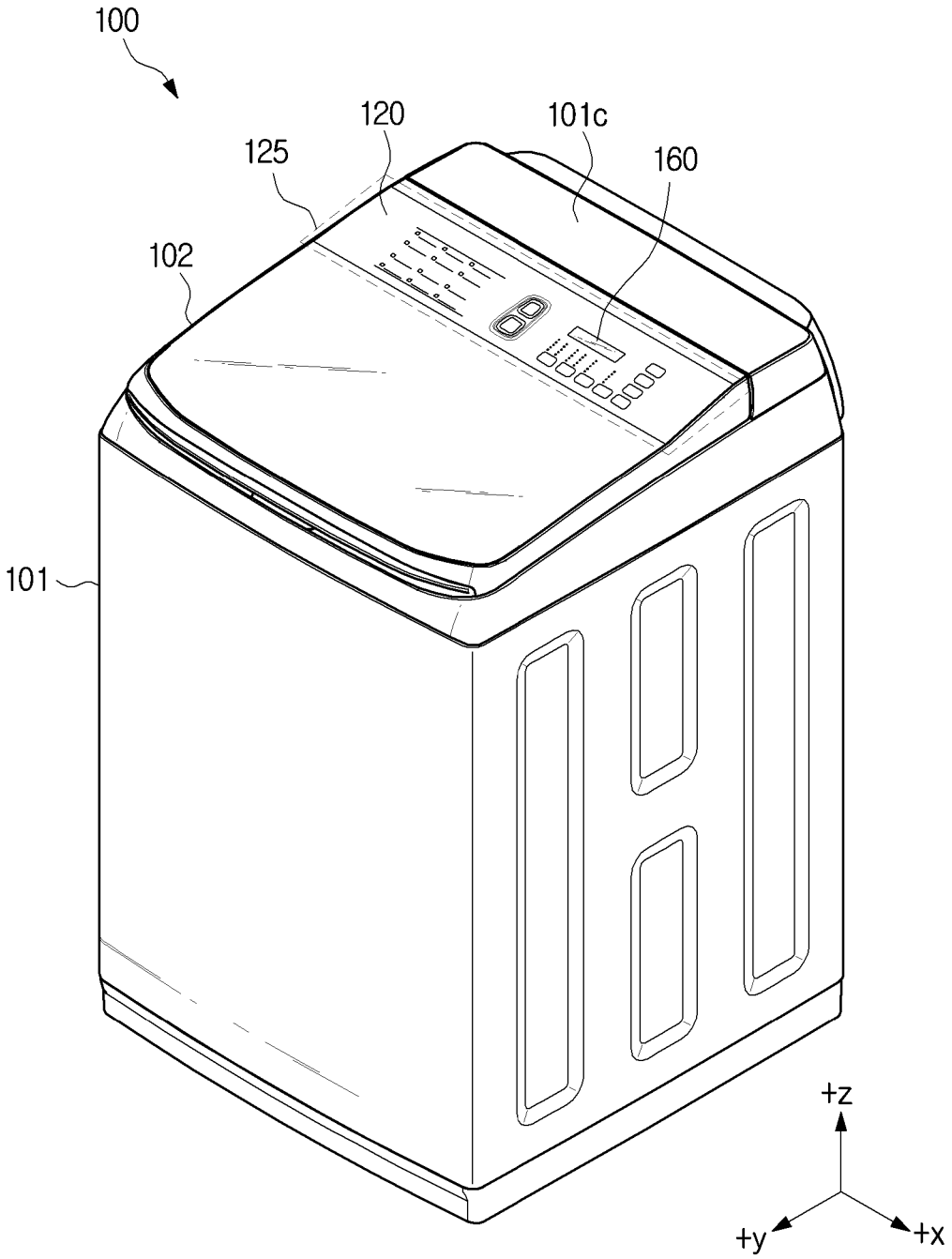
FIGS. 1A and 1B are perspective views of a washing machine according to an embodiment of the present disclosure.

Embodiments of the present disclosure will be described in detail with reference to the accompanying drawings. Like reference numerals or symbols denoted in the drawings represent members or components that perform the substantially same functions.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

Like reference numerals in the drawings denote members performing substantially the same function.

Hereinafter, the embodiments of the present disclosure will be described in detail with reference to the accompanying drawings.

Figure 1B:
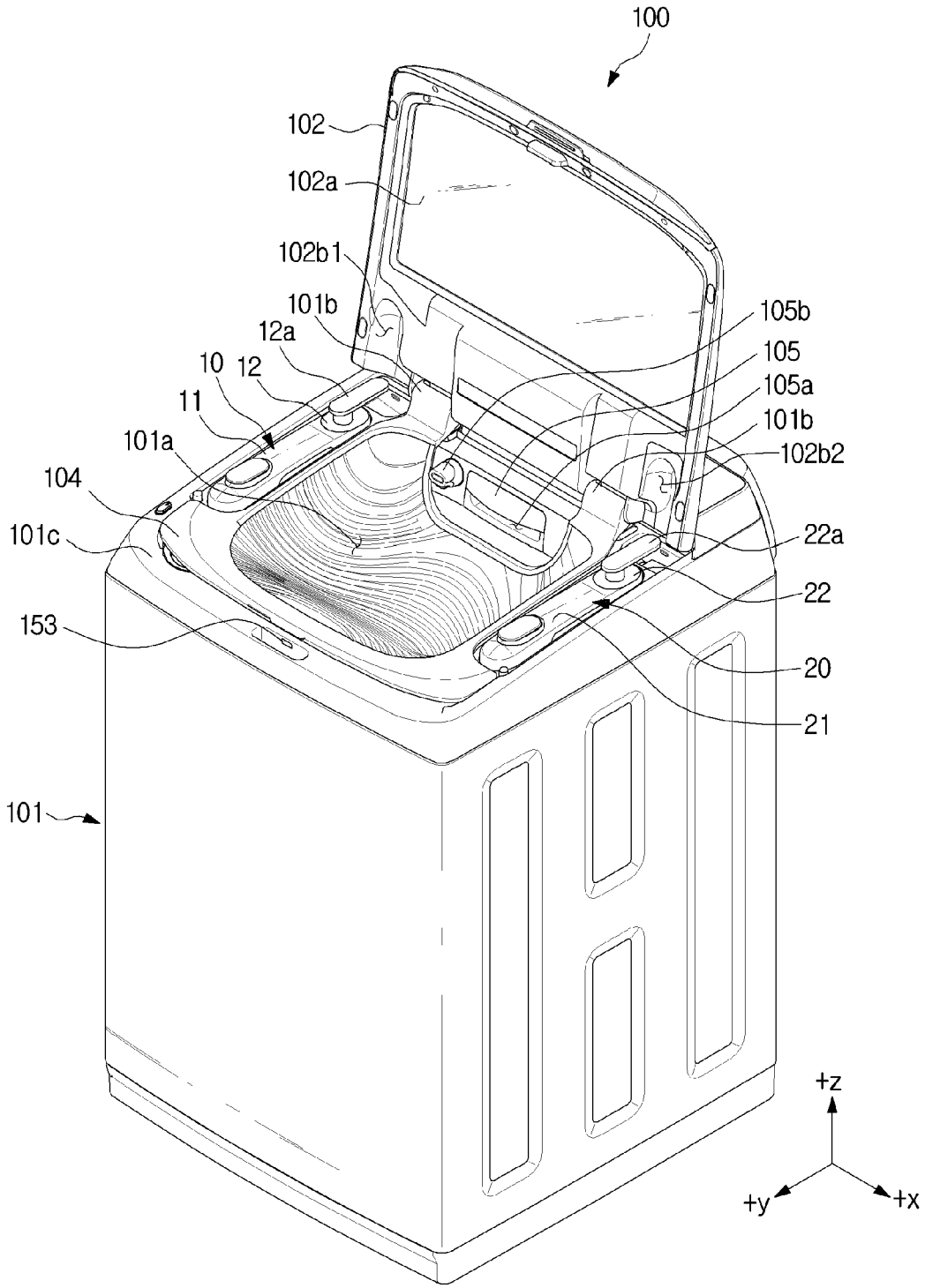

FIGS. 1A and 1B are perspective views of a washing machine according to an embodiment of the present disclosure.

Figure 2:
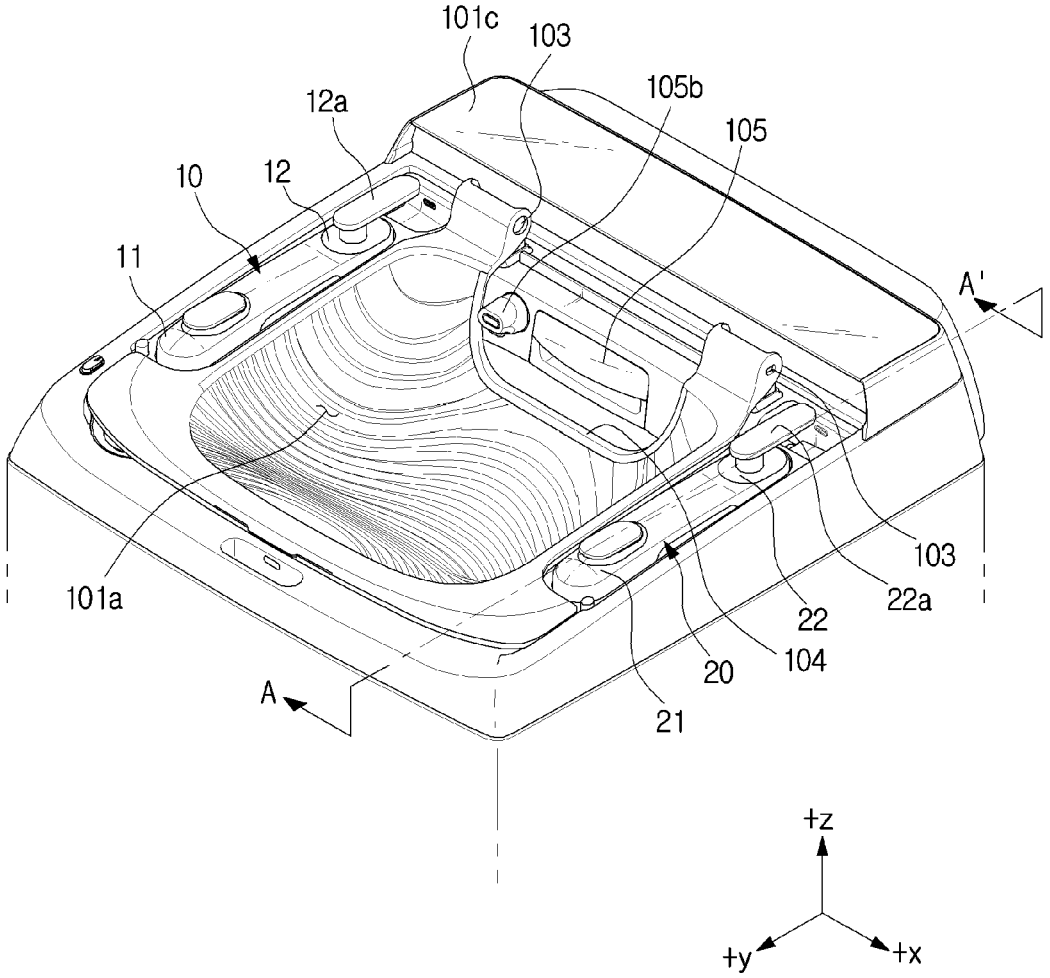
FIG. 2 is a perspective view showing a detergent supply unit and a softening agent supply unit according to an embodiment of the present disclosure.

FIG. 2 is a perspective view showing a detergent supply unit and a softening agent supply unit according to an embodiment of the present disclosure.

FIGS. 1A to 2, a washing machine 100 may include a main body 101 forming an outer appearance, and a door 102 located on a top 101*c* of the main body 101, and being opened or closed by a hinge.

The main body 101 may include a tub 103*b* (see FIG. 9) to store washing water supplied to the main body 101, and a rotating tub 103*a* disposed in the inside of the tub 103*b* and configured to rotate in a clockwise or counterclockwise direction. The tub 103*b* and the rotating tub 103*a* are collectively called a washing tub 103.

The washing machine 100 may include a detergent supply unit 10 coupled with a water supply portion 140 (see FIG. 10) to supply washing water (for example, cold water or hot water) to the main body 101 and a detergent supply container 11 to contain a detergent, and configured to mix washing water supplied from the water supply portion 140 with the detergent to supply the detergent mixed water to the rotating tub 103*a*. Also, the washing machine 100 may include a softening agent supply unit 20 coupled with a softening agent supply container 21 to store a softening agent, and configured to mix washing water supplied from the water supply portion 140 with the softening agent to supply the softening agent mixed water to the rotating tub 103*a*.

In the top (for example, a portion is covered by the door 102 and the other portion is not covered by the door 102) 101*c* of the main body 101, an opening 101*a* through which a user can put laundry and take the laundry out may be formed. The opening 101*a* may be opened and closed by the door 102.

On an upper surface of the door 102, an input device 120 having a plurality of operation buttons (for example, a power button, a start button, etc.) and a plurality of function buttons (for example, a washing course, an option, etc.), and/or a display 160 to display operations and states of the washing machine 100 may be located. One of the input device 120 and the display 160 may be disposed on the top 101*c* of the main body 101. The input device 120 and the display 160 are collectively called an operation panel (OPE) 125.

The tub 103*b* may be installed in the inside of the main body 101, the rotating tub 103*a* may be installed in the inside of the tub 103*b*, and a pulsator (not shown) for generating water current may be installed on a bottom of the rotating tub 103*a*.

Below the tub 103*b* (for example, at a lower end of the main body 101), a motor 170 for driving the rotating tub 103*a* and the pulsator (not shown), and a drain 180 for discharging contaminated washing water used in washing to the outside may be disposed.

The washing machine 100 may rotate laundry filled in the rotating tub 103*a* inside the tub 103*b*, a detergent (or a detergent and a softening agent), and washing water through the pulsator (not shown) rotating by a driving force of the motor 170, thereby washing the laundry.

The washing machine 100 which washes the laundry may rinse the laundry by supplying washing water (or supplying washing water and a softening agent) several times and discharging contaminated washing water several times. When the rinsing is completed, the washing machine 100 may drain contaminated washing water (or washing water) through the drain 180. After the drainage is completed, the washing machine 100 may rotate the rotating tub 103*a* at high speed to dehydrate washing water remaining in the laundry.

In the top 101*c* of the main body 101, a door sensor (or a door switch) 153 for detecting opening/closing of the door 102 may be disposed. The door sensor 153 may be disposed in the door 102. There may be provided a plurality of door sensors 153 (for example, one is disposed in a front portion (for example, in a positive (+) y-axis direction) of the door 102 and the other one(s) is disposed in a rear portion (for example, in a negative (−) y-axis direction) of the door 102 adjacent to a hinge 101*b*).

In the upper portion (for example, below the door 101 and above the washing tub 103) of the main body 101, a detergent case 105 having an outlet 105*a* to discharge detergent mixed water and/or softening agent mixed water to the rotating tub 103*a* may be disposed. Washing water supplied from the water supply portion 140 may be discharged through the outlet 105*a* of the detergent case 105.

The door 102 may include a door glass 102*a* corresponding to a part of the door 102. The door glass 102*a* may be made of a transparent material (for example, acrylic, plastic, glass, or the like) to allow a user to see the inside of the main body 101 below the door 102.

When the door 102 covers the opening 101*a*, a first handle accommodating portion (or a detergent pump handle accommodating portion) 102*b*1 to accommodate a pump handle (or, a pump handle having a detergent supply path therein) 12*a* of the detergent supply container 11 may be located in one side of a bottom of the door 102. Also, a second handle accommodating portion (or a softening agent pump handle accommodating portion) 102*b*2 to accommodate a pump handle (or, a pump handle having a softening agent supply path therein) 22*a* of the softening agent supply container 21 may be located in the other side of the bottom of the door 102.

The first handle accommodating portion 102*b*1 may be implemented as a first handle case (not shown) made of a transparent material, wherein the first handle case may be detachable from the door 102. When the first handle case is detached from the door 102, the user can see the pump handle (or, an automatically pumped pump handle) 12*a* of the detergent supply container 11 located below the door 102 through the transparent window (not shown, for example, located above the first handle case in a positive (+) z-axis direction) corresponding to the first handle case in the door 102 covering the opening 101*a*.

The second handle accommodating portion 102*b*2 may be implemented as a second handle case (not shown) made of a transparent material, wherein the second handle case may be detachable from the door 102. When the second handle case is detached from the door 102, the user can see the pump handle (or, an automatically pumped pump handle) 22*a* of the softening agent supply container 21 located below the door 102 through the transparent window (not shown, for example, located above the first handle case in the positive (+) z-axis direction) corresponding to the second handle case in the door 102 covering the opening 101*a*.

A light source (for example, a Light Emitting Diode (LED) or the like) may be disposed adjacent to the transparent window (not shown). When power is supplied to the light source (not shown), the light source may provide light toward the transparent window (not shown) from which one of the first handle accommodating portion 102*b*1 and the second handle accommodating portion 102*b*2 is separated.

An additional door 104 for performing washing (for example, hand washing or rough washing) independently from washing being performed in the washing tub 103 may be positioned between the door 102 and the opening 101*a* of the main body 101. In the washing machine 100 having the additional door 104, the additional door 104 is referred to as a second door, and the door 102 is referred to as a first door. The washing machine having the additional door 104 may include an additional water supply opening 105*b* to supply washing water to the additional door 104.

Figure 3:
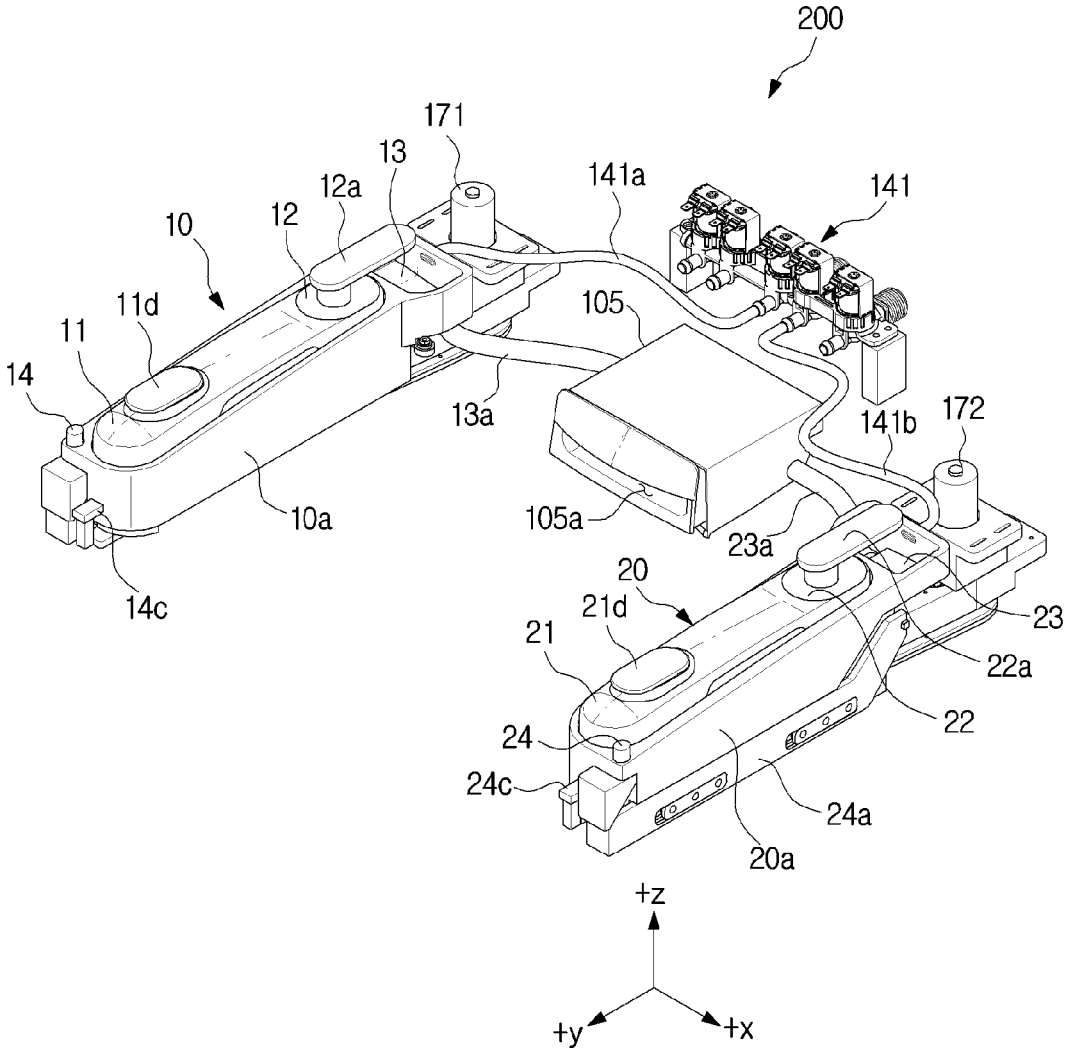
FIG. 3 is a schematic perspective view of a supply assembly according to an embodiment of the present disclosure.

FIG. 3 is a schematic perspective view of a supply assembly according to an embodiment of the present disclosure.

Figure 4A:
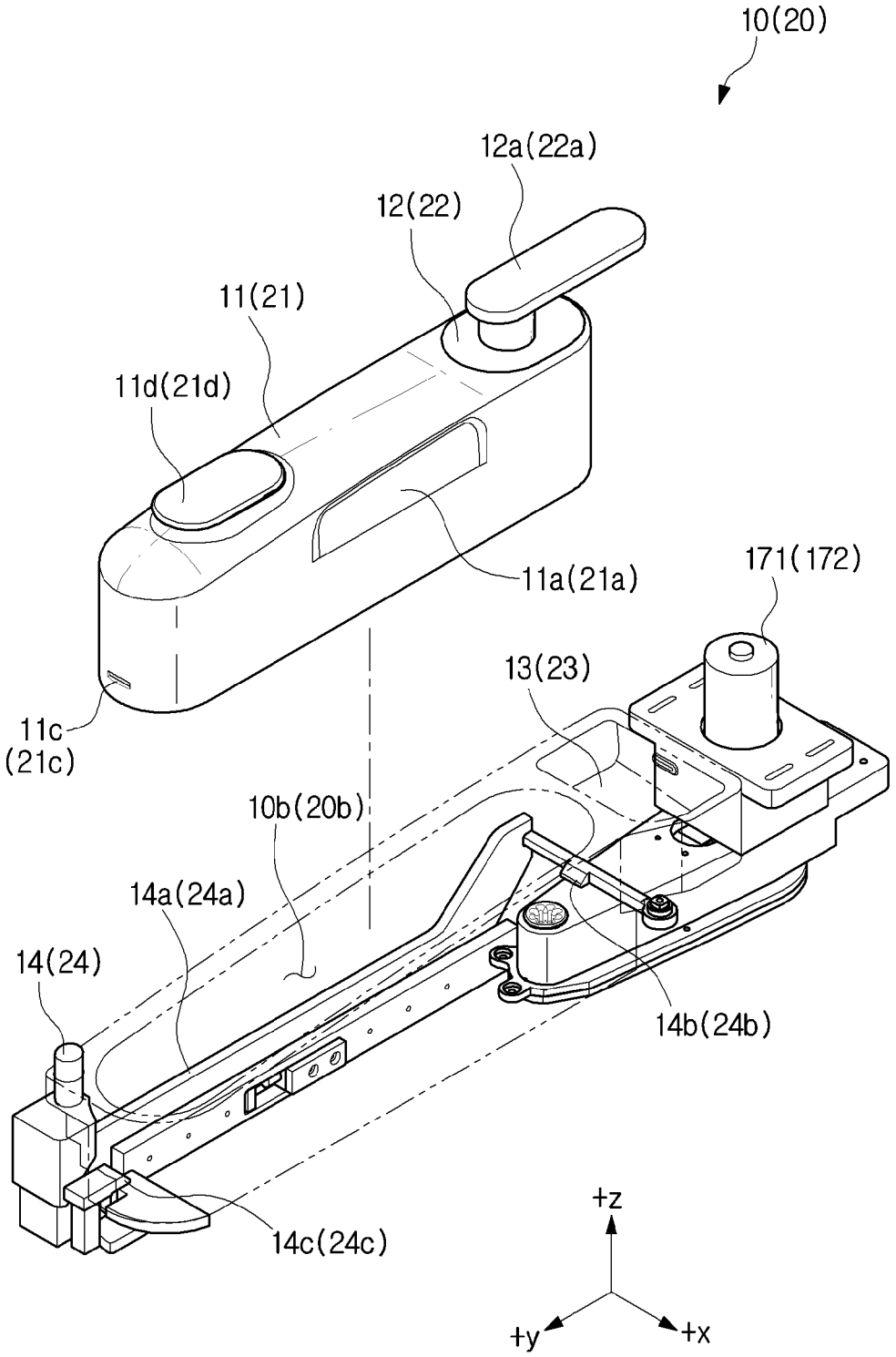
FIG. 4A is a schematic perspective view of a detergent supply container (a softening agent supply container) and a detergent supply unit (a softening agent supply unit), according to an embodiment of the present disclosure.
Figure 4B:
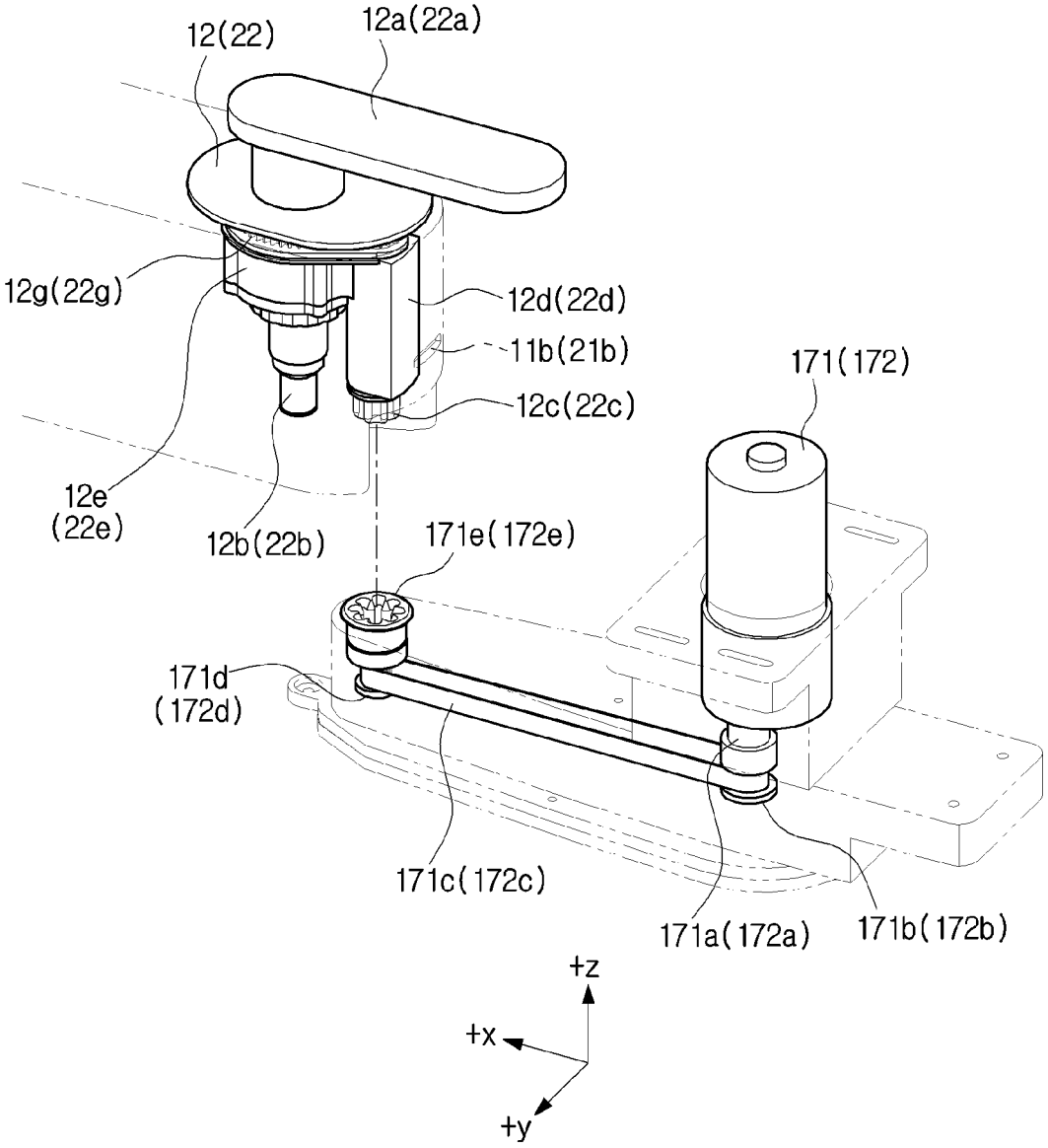
FIG. 4B is a schematic exploded perspective view of a detergent supply unit having a detergent supply pump, a motor, and a belt, according to an embodiment of the present disclosure.

FIG. 4A is a schematic perspective view of a detergent supply container (a softening agent supply container) and a detergent supply unit (a softening agent supply unit), according to an embodiment of the present disclosure. FIG. 4B is a schematic exploded perspective view of a detergent supply unit having a detergent supply pump, a motor, and a belt, according to an embodiment of the present disclosure.

Figure 4C:
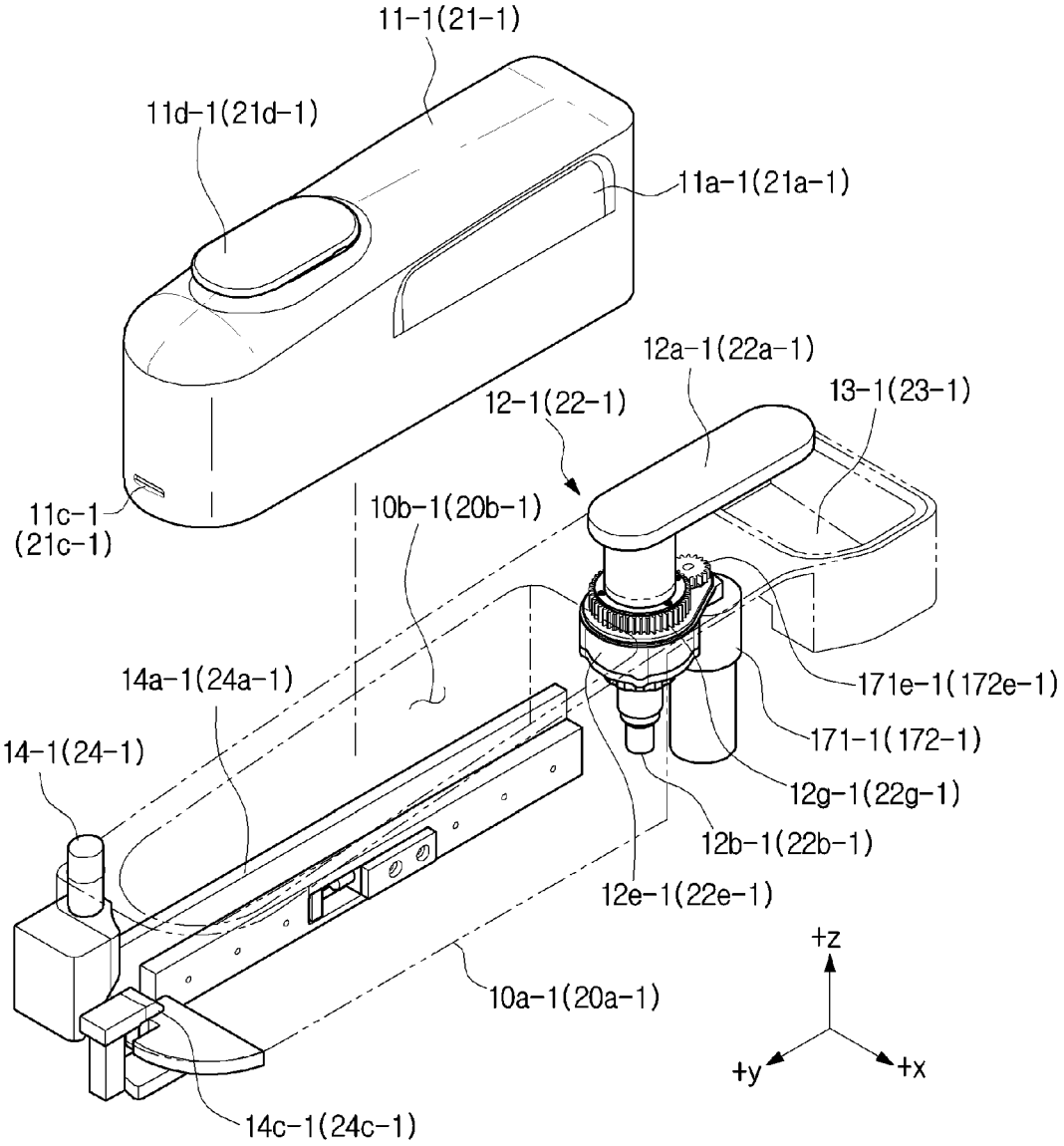
FIG. 4C is a schematic perspective view of a detergent supply container (a softening agent supply container) and a detergent supply unit (a softening agent supply unit), according to another embodiment of the present disclosure.
Figure 4D:
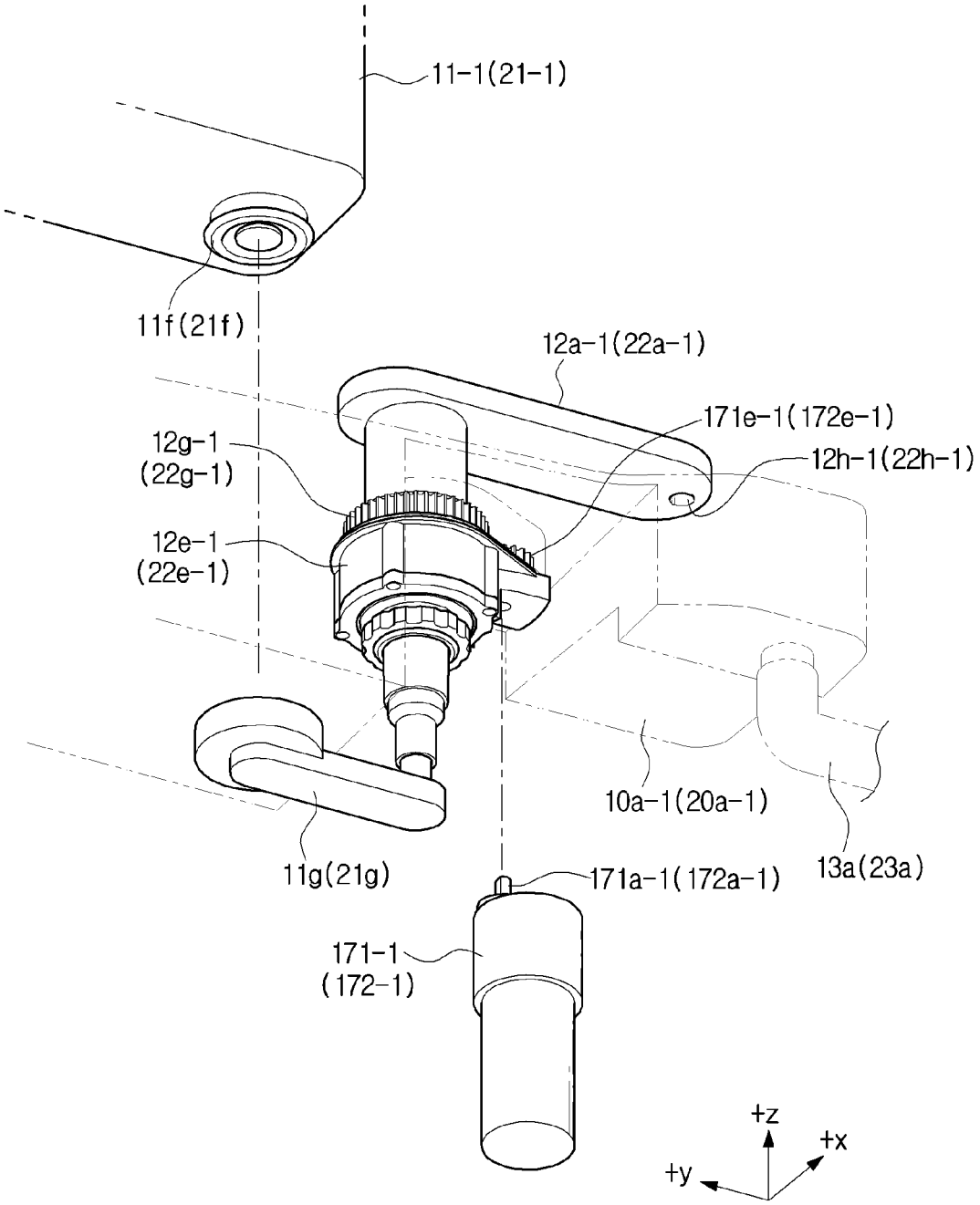
FIG. 4D is a schematic exploded perspective view of a detergent supply unit having a detergent supply pump, a motor, and a gear, according to another embodiment of the present disclosure.

FIG. 4C is a schematic perspective view of a detergent supply container (a softening agent supply container) and a detergent supply unit (a softening agent supply unit), according to another embodiment of the present disclosure. FIG. 4D is a schematic exploded perspective view of a detergent supply unit having a detergent supply pump, a motor, and a gear, according to another embodiment of the present disclosure.

Referring to FIGS. 3 to 4D, a supply assembly 200 may be provided to supply detergent mixed water and softening agent mixed water to the washing tub 103. Also, the supply assembly 200 may supply a detergent and a softening agent to the washing tub 103. The supply assembly 200 may include the detergent supply unit 10 and the softening agent supply unit 20. However, the supply assembly 200 may include only the detergent supply unit 10 to supply detergent mixed water to the washing tub 103. The supply assembly 200 may further include a bleach supply unit (not shown). Also, one of the detergent supply unit 10 and the softening agent supply unit 20 of the supply assembly 200 may be used as the bleach supply unit (not shown).

The supply assembly 200 may include the detergent supply unit 10, the softening agent supply unit 20, a water supply unit 141, a plurality of water supply hoses 141*a* and 141*b*, a plurality of mixed water hoses 13*a* and 13*b*, and the detergent case 105. Any one(s) of the above-mentioned components of the supply assembly 200 may be omitted or modified, or another component(s) may be added to the supply assembly 200.

The detergent supply unit 10 may be different from the softening agent supply unit 20 in that a detergent and a softening agent are respectively contained in the supply containers 11 and 21. The supply container for accommodating a detergent may be the detergent supply container 11, and the supply container for accommodating a softening agent may be the softening agent supply container 21. Also, a supply container for accommodating bleach may be a bleach supply container (not shown). Hereinafter, the detergent supply unit 10 will be described, and the following description about the detergent supply unit 10 can be applied in the same manner to the softening agent supply unit 20.

The detergent supply unit 10 may accommodate (for example, detachably install) the detergent supply container 11 in an accommodating portion 10*b* of the housing 10*a* connected to the main body 101. The detergent supply container 11 accommodated in the accommodating portion 10*b* may be fixed by a plurality of protrusions 14*b* and 14*c* formed in the inner surface of the accommodating portion 10*b*. In the housing 10*a*, a detergent mixing tub 13 which is space separated from the accommodating portion 10*b* may be disposed at one end (for example, between the accommodating portion 10*b* and the motor 171) of the accommodating portion 10*b*.

The detergent supply container 11 to accommodate a detergent may include a groove 11*a* that can be gripped by a user, a catching portion 11*b* (see FIG. 4B) corresponding to the protrusion 14*b*, a catching portion 11*c* corresponding to the protrusion 14*c*, and a cap 11*d* covering an adding portion (not shown) for adding a detergent. A detergent pump 12 may be coupled with the detergent supply container 11. A detergent suction tube 12*b* (see FIG. 5A) of the detergent pump 12 may contact (or directly contact) a detergent accommodated in the inside of the detergent supply container 11.

The detergent supply container 11 may be made of a transparent material (for example, acrylic, plastic, glass, or the like) to allow the user to check a residual amount of detergent accommodated in the detergent supply container 11 and the inside of the detergent supply container 11. Therefore, the user can intuitively check a residual amount of detergent accommodated in the detergent supply container 11 made of a transparent material.

The detergent supply unit 10 may include a detergent mixing tub (or, referred to as a first mixing tub) 13 which is formed in the housing 10*a* and in which a detergent is mixed with washing water. A part of a detergent accommodated in the detergent supply container 11 may be sucked through the detergent suction tube 12*b* of the detergent pump 12, and then supplied to the detergent mixing tub 13 through a supply path 12*i* (see FIG. 5A) formed in the inside of the pump handle 12*a*. The detergent passed through the supply path 12*i* formed in the inside of the pump handle 12*a* may fall into the detergent mixing tub 13 through a detergent discharging opening 12*h* (see FIG. 5A). Since a detergent falls, a length of the supply path 12*i* through which a detergent is supplied to the detergent mixing tub 13 can be shortened (reduced). Since the length of the supply path 12*i* is shortened, hardening (for example, a supplied detergent is hardened in the inside of the supply path 12*i* without being diluted) of detergent can be reduced.

The detergent supply container 11 accommodated in the accommodating portion 10*b* may be detached from the detergent supply unit 10 when a release button 14 is pressed. When the release button 14 is pressed, a release link 14*a* and the protrusion 14*b* may move, and accordingly, the detergent supply container 11 accommodated in the accommodating portion 10*b* may be detached from the detergent supply unit 10.

A driving force of the motor 171 may be transferred to a detergent pump driving shaft (not shown) of a detergent pump driving shaft body 12*d* through a driving shaft 171*a*, a pulley 171*b*, a belt 171*c*, and a connector (for example, exposed to the outside of the detergent supply container) 12*c* coupled with a connector guide 171*e* of a driven shaft 171*d*. A driving force transferred (for example, by gear engagement, coupling, or belt engagement) to a gear 12*g* of a detergent pump body 12*e* connected to a gear 12*f* of a detergent pump driving shaft (not shown) inside the detergent pump driving shaft body 12*d* may be transferred to a rotary cam (not shown) installed in the inside of the detergent pump body 12*e*. A motion (for example, a rotary motion) of the rotary cam by the driving force may operate the pump handle 12*a* (for example, a reciprocating motion or an up-down reciprocating motion). Details about this operation will be described later.

A detergent contained in the detergent supply container 11 may be pumped by the driving force of the motor 171 and the motion of the detergent pump 12 to thus be provided to the detergent mixing tub 13.

The detergent mixing tub 13 may contain washing water supplied through the water supply unit 141 and the water supply hose 141*a*, as well as a detergent. In the detergent mixing tub 13, the detergent may be mixed with the washing water to form detergent mixed water. The detergent mixed water formed in the detergent mixing tub 13 may pass through the mixed water hose 13*a* connected to the detergent mixing tub 13 below the detergent mixing tub 13, and then be discharged to the washing tub 103 through the outlet 105*a* of the detergent case 105. The water supply unit 141 may supply washing water directly to the detergent case 105 through a water supply hose (not shown).

The detergent mixed water may be discharged due to a difference in height between a port (not shown) of the water supply hose 141*a* connected to one side of the detergent mixing tub 13 and a port (not shown) of the mixed water hose 13*a* connected to a bottom of the detergent mixing tub 13.

The softening agent supply unit 20 may accommodate (for example, detachably install) the softening agent supply container 21 in an accommodating portion 20*b* of a housing 20*a*. The softening agent supply container 21 accommodated in the accommodating portion 20*b* may be fixed by a plurality of protrusions 24*b* and 24*c* formed in the inner surface of the accommodating portion 20*b*. In the housing 20*a*, a softening agent mixing tub 23 which is space separated from the accommodating portion 20*b* may be disposed at one end (for example, between the accommodating portion 20*b* and a motor 172) of the accommodating portion 20*b*.

The softening agent supply container 21 to contain a softening agent may include a groove 21*a* that can be gripped by the user, a catching portion 21*b* corresponding to the protrusion 24*b*, a catching portion 21*c* (see FIG. 4B) corresponding to the protrusion 24*c*, and a cap 21*d* covering an adding portion (not shown) for adding a softening agent. A softening agent pump 22 may be coupled with the softening agent supply container 21. A softening agent suction tube 22*b* (see FIG. 5A) of the softening agent pump 22 may contact the softening agent accommodated in the inside of the softening agent supply container 21.

The softening agent supply container 21 may be made of a transparent material (for example, acrylic, plastic, glass, or the like) to allow the user to check a residual amount of softening agent accommodated in the softening agent supply container 21 and the inside of the softening agent supply container 21. Therefore, the user can intuitively check a residual amount of softening agent accommodated in the softening agent supply container 21 made of a transparent material.

The softening agent supply unit 20 may include a softening agent mixing tub (or, referred to as a second mixing tub) 23 which is formed in the housing 20*a* and in which a softening agent is mixed with washing water. A part of a softening agent accommodated in the softening agent supply container 21 may be sucked through the softening agent suction tube 22*b* of the softening agent pump 22, and then supplied to the softening agent mixing tub 23 through a supply path 22*i* (see FIG. 5A) formed in the inside of the pump handle 22*a*. The softening agent passed through the supply path 22*i* formed in the inside of the pump handle 22*a* may fall into the softening agent mixing tub 23 through a softening agent discharging opening 22*h* (see FIG. 5A). Since a softening agent falls, a length of the supply path 22*i* through which a softening agent is supplied to the softening agent mixing tub 23 can be shortened (reduced). Since the length of the supply path 22*i* is shortened, hardening (for example, a supplied softening agent is hardened in the inside of the supply path 22*i* without being diluted) of softening agent can be reduced.

The softening agent supply container 21 accommodated in the accommodating portion 20*b* may be detached from the softening agent supply unit 20 when the release button 24 is pressed. When the release button 24 is pressed, a release link 24*a* and the protrusion 24*b* may move, and accordingly, the softening agent supply container 21 accommodated in the accommodating portion 20*b* may be detached from the softening agent supply unit 20.

A driving force of the motor 172 may be transferred to a softening agent pump driving shaft (not shown) of a softening agent pump driving shaft body 22*d* through a driving shaft 172*a*, a pulley 172*b*, a belt 172*c*, and a connector (for example, exposed to the outside of the softening agent supply container) 22*c* coupled with a connector guide 172*e* of a driven shaft 172*d*. A driving force transferred to a gear 22*g* of a softening agent pump body 22*e* connected to a gear 22*f* of the softening agent pump driving shaft (not shown) inside the softening agent pump driving shaft body 22*d* may be transferred to a rotary cam (not shown) installed in the inside of the softening agent pump body 22*e*. A motion (for example, a rotary motion) of the rotary cam by the driving force may operate the pump handle 22*a* (for example, a reciprocating motion or an up-down reciprocating motion). Details about this operation will be described later.

A softening agent contained in the softening agent supply container 11 may be pumped by the driving force of the motor 172 and the motion of the softening agent pump 22, and thus provided to the softening agent mixing tub 23.

The softening agent mixing tub 23 may contain washing water supplied through the water supply unit 141 and the water supply hose 141*a*, as well as the softening agent. In the softening agent mixing tub 23, the softening agent may be mixed with the washing water to form softening agent mixed water. The softening agent mixed water formed in the softening agent mixing tub 13 may pass through the mixed water hose 13*b* connected to the softening agent mixing tub 23 below the softening agent mixing tub 23, and then be discharged to the washing tub 103 through the outlet 105*a* of the detergent case 105. The softening agent mixed water may be discharged due to a difference in height between a port (not shown) of the water supply hose 141*b* connected to one side of the softening agent mixing tub 23 and a port (not shown) of the mixed water hose 13*b* connected to a bottom of the softening agent mixing tub 23.

Referring to FIGS. 4C and 4D showing another embodiment of the present disclosure, the supply assembly 200 may be provided to supply detergent mixed water and softening agent mixed water to the washing tub 103. Also, the supply assembly 200 may be provided to supply a detergent and a softening agent to the washing tub 103. The supply assembly 200 may include a detergent supply unit 10-1 and a softening agent supply unit 20-1 according to another embodiment of the present disclosure. Also, the supply assembly 200 may include only the detergent supply unit 10-1 to supply detergent mixed water to the washing tub 103. The supply assembly 200 may further include a bleach supply unit (not shown). Also, one of the detergent supply unit 10-1 and the softening agent supply unit 20-1 of the supply assembly 200 may be used as the bleach supply unit (not shown).

The water supply unit 141, the water supply hoses 141*a* and 141*b*, the mixed water hoses 13*a* and 13*b*, and the detergent case 105 of the supply assembly 200, except for the detergent supply unit 10-1 and the softening agent supply unit 20-1 of the supply assembly 200, are substantially similar to the water supply unit 141, the water supply hoses 141*a* and 141*b*, the mixed water hoses 13*a* and 13*b*, and the detergent case 105 of FIGS. 3 to 4B, and accordingly, detailed descriptions thereof will be omitted. Any one(s) of the above-mentioned components of the supply unit 200 may be omitted or modified, or another component(s) may be added to the supply unit 200.

The detergent supply unit 10-1 may accommodate (for example, detachably install) a detergent supply container 11-1 in an accommodating portion 10*b*-1 of a housing 10*a*-1 connected to the main body 101. The detergent supply container 11-1 accommodated in the accommodating portion 10*b*-1 may be fixed by a protrusion 14*c*-1. In the housing 10*a*-1, a detergent mixing tub 13-1 may be formed.

The detergent supply container 11-1 to store a detergent may include a groove 11*a*-1 that can be gripped by a user, a catching portion 11*c*-1 (see FIG. 4C) corresponding to the protrusion 14*c*-1, and a cap 11*d*-1 covering an adding portion (not shown) for adding a detergent. The detergent supply container 11-1 may be different from the detergent pump 12 disposed in the housing 10*a*-1. A detergent suction tube 12*b*-1 of the detergent pump 12 may be coupled with a detergent supply portion 11*g* connected to a detergent outlet 11*f* formed in a bottom of the detergent supply container 11-1.

The detergent supply unit 10-1 may include the detergent mixing tub (also, referred to as a third mixing tub) 13-1 which is formed in the housing 10*a*-1 and in which a detergent is mixed with washing water. A part of a detergent accommodated in the detergent supply container 11-1 may be sucked into the detergent suction tube 12*b*-1 of the detergent pump 12-1 coupled with the detergent supply portion 11*g* connected to the detergent outlet 11*f*, and then supplied to the detergent mixing tub 13-1 through a supply path 12*i*-1 (see FIG. 5C) formed in the inside of a pump handle 12*a*-1. The detergent passed through the supply path 12*i*-1 formed in the inside of the pump handle 12*a*-1 may fall into the detergent mixing tub 13-1 through a detergent discharging opening 12*h*-1 (see FIG. 5C). Since a detergent falls, a length of the supply path 12*i*-1 through which a detergent is supplied to the detergent mixing tub 13-1 can be shortened (reduced).

The detergent supply container 11-1 accommodated in the accommodating portion 10*b*-1 may be detached from the detergent supply unit 10-1 when a release button 14-1 is pressed. When the release button 14-1 is pressed, a release link 14*a*-1 and the protrusion 14*c*-1 may move, and accordingly, the detergent supply container 11-1 accommodated in the accommodating portion 10*b*-1 may be detached from the detergent supply unit 10-1.

A driving force of a motor 171-1 may be transferred to a gear 12*g*-1 of the detergent pump 12-1 through a driving shaft 171*a*-1 and a gear 171*e*-1. A driving force transferred (for example, by gear engagement, coupling, or belt engagement) to the inside of the detergent pump body 12*e* through a rotation of the gear 12*g*-1 of the detergent pump 12-1 may be transferred to a rotary cam (not shown) installed in the inside of the detergent pump body 12*e*-1. A motion (for example, a rotary motion) of the rotary cam by the driving force may operate the pump handle 12*a*-1 (for example, a reciprocating motion or an up-down reciprocating motion). Details about this operation will be described later.

A detergent contained in the detergent supply container 11-1 may be pumped by the driving force of the motor 171-1 and the motion of the detergent pump 12-1, and thus provided to the detergent mixing tub 13-1.

The detergent mixing tub 13-1 may contain washing water supplied through the water supply unit 141 and the water supply hose 141*a*, as well as the detergent. In the detergent mixing tub 13-1, the detergent may be mixed with the washing water to form detergent mixed water. The detergent mixed water formed in the detergent mixing tub 13-1 may pass through the mixed water hose 13*a* connected to the detergent mixing tub 13-1 below the detergent mixing tub 13-1, and then be discharged to the washing tub 103 through the outlet 105*a* of the detergent case 105. The water supply unit 141 may supply washing water directly to the detergent case 105 through a water supply hose (not shown).

The detergent mixed water may be discharged due to a difference in height between the port (not shown) of the water supply hose 141*a* connected to one side of the detergent mixing tub 13-1 and the port (not shown) of the mixed water hose 13*a* connected to a bottom of the detergent mixing tub 13-1.

The softening agent supply unit 20-1 may accommodate (for example, detachably install) a softening agent supply container 21-1 in an accommodating portion 20*b*-1 of a housing 20*a*-1 connected to the main body 101. The softening agent supply container 21-1 accommodated in the accommodating portion 20*b*-1 may be fixed by a protrusion 24*c*-1. In the housing 20*a*-1, a softening agent mixing tub 23-1 may be formed.

The softening agent supply container 21-1 to accommodate a softening agent may include a groove 21*a*-1 that can be gripped by the user, a catching portion 21*c*-1 (see FIG. 4C) corresponding to the protrusion 24*c*-1, and a cap 21*d*-1 covering an adding portion (not shown) for adding a softening agent. The softening agent supply container 21-1 may be different from the softening agent pump 22 disposed in the housing 20*a*-1. A softening agent suction tube 22*b*-1 of the softening agent pump 22 may be coupled with a softening agent supply portion 21*g* connected to a softening agent outlet 21*f* formed in a bottom of the softening agent supply container 21-1.

The softening agent supply unit 20-1 may include the softening agent mixing tub (also, referred to as a fourth mixing tub) 23-1 which is formed in the housing 20*a*-1 and in which a softening agent is mixed with washing water. A part of a softening agent accommodated in the softening agent supply container 21-1 may be sucked into the softening agent suction tube 22*b* of the softening agent pump 22 coupled with the softening agent supply portion 21*g* connected to the softening agent outlet 21*f*, and then supplied to the softening agent mixing tub 23-1 through a supply path 22*i*-1 (see FIG. 5C) formed in the inside of the pump handle 22*a*-1. The softening agent passed through the supply path 22*i*-1 formed in the inside of the pump handle 22*a*-1 may fall into the softening agent mixing tub 23-1. Since a softening agent falls, a length of the supply path 22*i*-1 through which a softening agent is supplied to the softening agent mixing tub 23-1 can be shortened (reduced).

The softening agent supply container 21-1 accommodated in the accommodating portion 20*b*-1 may be detached from the softening agent supply unit 20-1 when a release button 24-1 is pressed. When the release button 24-1 is pressed, a release link 24*a*-1 and the protrusion 24*c*-1 may move, and accordingly, the softening agent supply container 21-1 accommodated in the accommodating portion 20*b*-1 may be detached from the softening agent supply unit 20-1.

A driving force of a motor 172-1 may be transferred to a gear 22*g*-1 of the softening agent pump 22-1 through a driving shaft 172*a*-1 and a gear 172*e*-1. A driving force transferred (for example, by gear engagement, coupling, or belt engagement) to the inside of the softening agent pump body 22*e* through a rotation of the gear 22*g*-1 of the softening agent pump 22-1 may be transferred to a rotary cam (not shown) installed in the inside of the softening agent pump body 22*e*-1. A motion (for example, a rotary motion) of the rotary cam by the driving force may operate the pump handle 22*a*-1 (for example, a reciprocating motion or an up-down reciprocating motion). Details about this operation will be described later.

A softening agent contained in the detergent supply container 21-1 may be pumped by the driving force of the motor 172-1 and the motion of the detergent pump 22-1, and thus provided to the softening agent mixing tub 23-1.

The softening agent mixing tub 23-1 may contain washing water supplied through the water supply unit 141 and the water supply hose 141*a*, as well as the softening agent. In the softening agent mixing tub 23-1, the softening agent may be mixed with the washing water to form softening agent mixed water. The softening agent mixed water formed in the softening agent mixing tub 23-1 may pass through the mixed water hose 13*a* connected to the softening agent mixing tub 23-1 below the softening agent mixing tub 23-1, and then be discharged to the washing tub 103 through the outlet 105*a* of the detergent case 105. The water supply unit 141 may supply washing water directly to the detergent case 105 through a water supply hose (not shown).

The softening agent mixed water may be discharged due to a difference in height between a port (not shown) of the water supply hose 141*a* connected to one side of the detergent mixing tub 23-1 and a port (not shown) of the mixed water hose 13*a* connected to a bottom of the softening agent mixing tub 23-1.

Figure 5A:
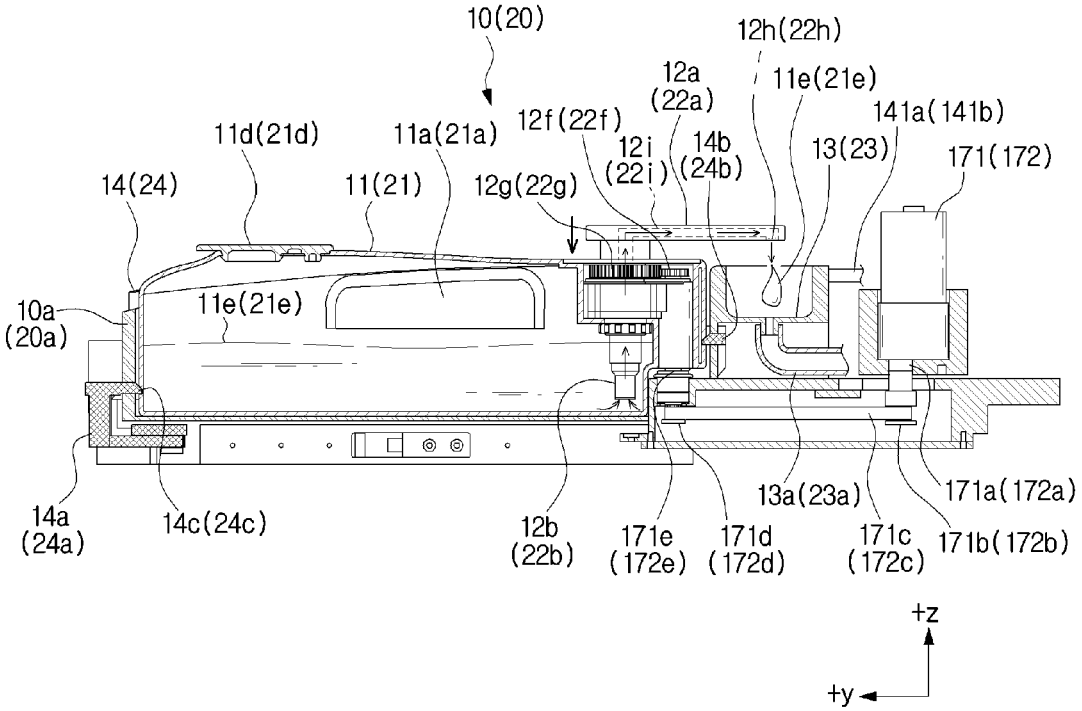
FIGS. 5A and 5B are schematic cross-sectional views showing a detergent supply unit for supplying a detergent automatically by a pump connected to a motor, according to an embodiment of the present disclosure.
Figure 5B:
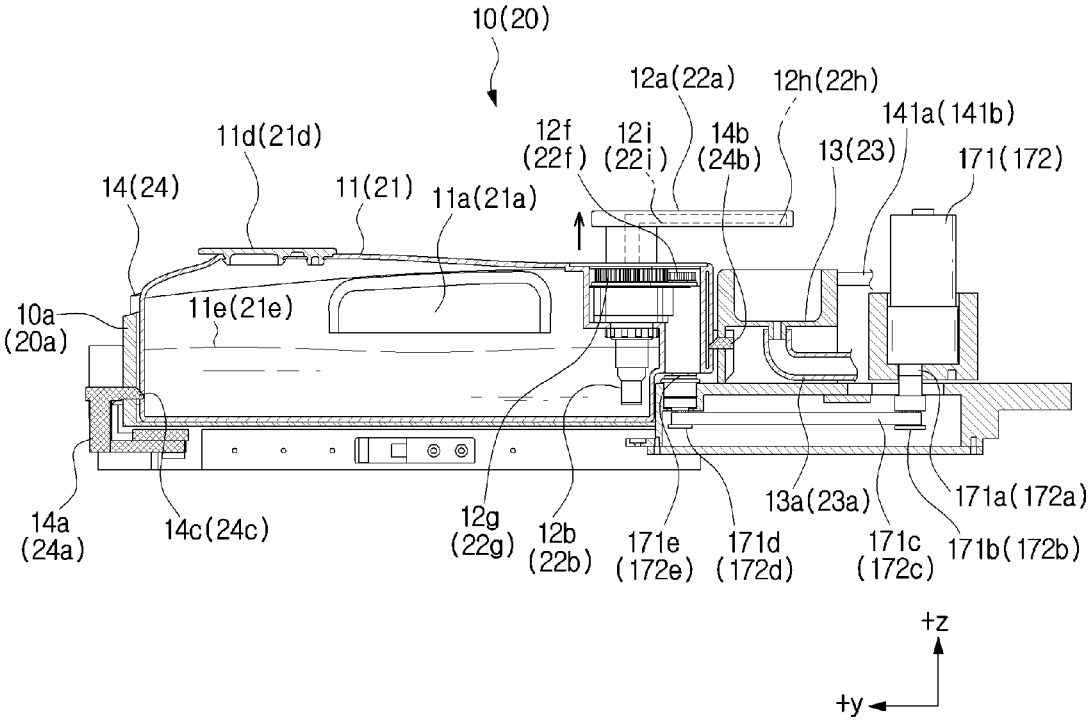
Figure 5C:
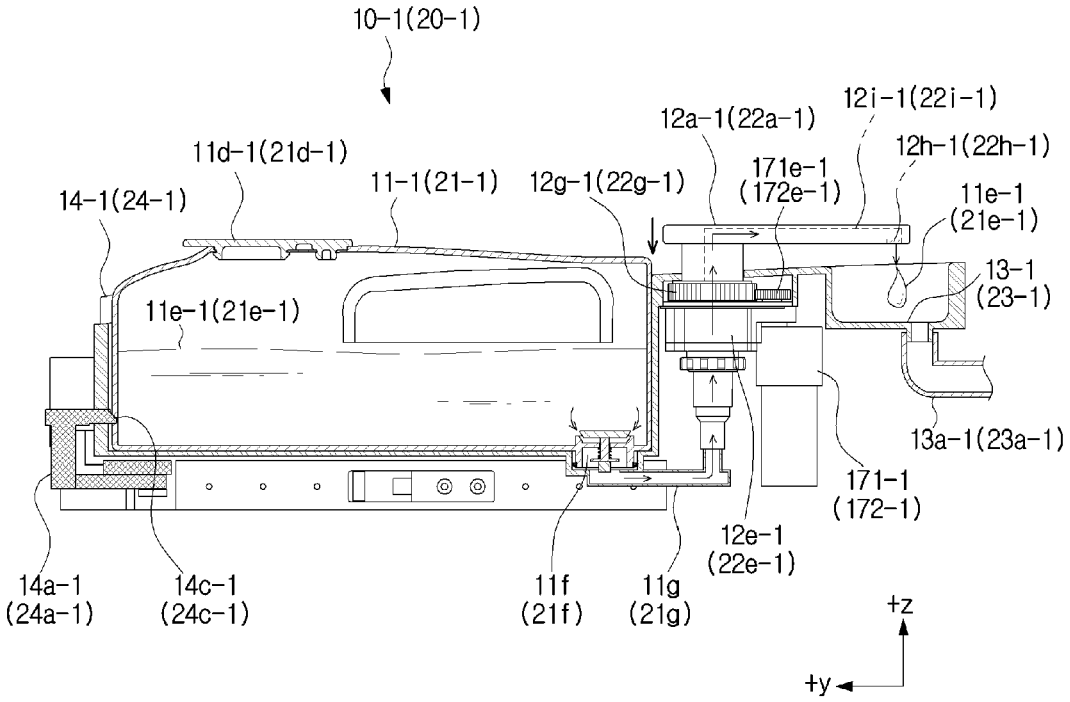
FIGS. 5C and 5D are schematic cross-sectional views showing a detergent supply unit for supplying a detergent automatically by a pump connected to a motor, according to an embodiment of the present disclosure.
Figure 5D:
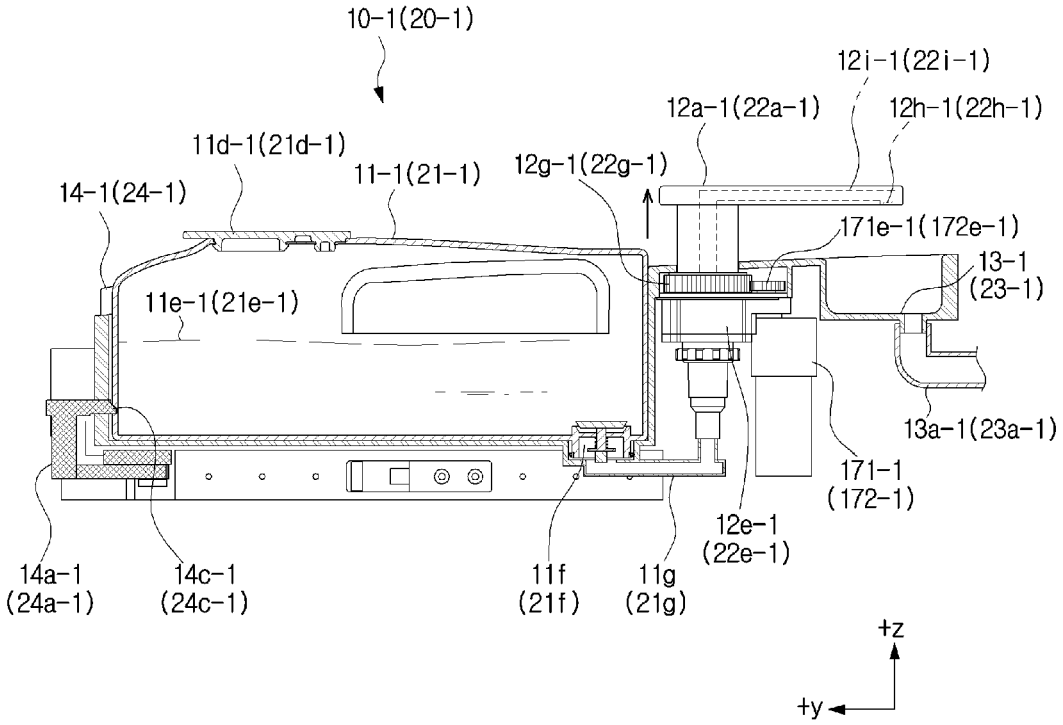

FIGS. 5A and 5B are schematic cross-sectional views showing a detergent supply unit for supplying a detergent automatically by a pump connected to a motor, according to an embodiment of the present disclosure. FIGS. 5C and 5D are schematic cross-sectional views showing a detergent supply unit for supplying a detergent automatically by a pump connected to a motor, according to an embodiment of the present disclosure.

In FIGS. 5A and 5B, the detergent supply unit 10 for supplying a detergent automatically to the detergent mixing tub 13 is shown.

When laundry is accommodated in the washing tub 103, and the door 102 covers the opening 101*a* formed in the top 101*c* of the main body 101, a user may perform an input of selecting a washing course (for example, a normal course) and an option (for example, washing time, the number of times of rinsing, etc.).

If a weight of the accommodated laundry is calculated, at least one among an amount of detergent, an amount of softening agent, and an amount of bleach, which are to be supplied to the washing tub 103, may be calculated. If the weight of the accommodated laundry is calculated, the motor 171 of the detergent supply unit 10 may operate according to an amount of detergent which is to be supplied to the washing tub 103.

A driving force for operating the detergent pump 12 may be transferred from the motor 171. When the driving shaft 171*a* of the motor 171 rotates, the belt 171*c* contacting the pulley 171*b* coupled with the driving shaft 171*a* may rotate in the same direction as the driving shaft 171*c*.

When the belt 171*c* rotates, a driving force of the motor 171 may be transferred to the pulley 171*d* coupled with the driven shaft. Due to coupling (connection or contact) between the connector guide 171*e* coupled with the driven shaft and the connector 12*c* of the detergent pump driving shaft body 12*d*, a driving force of the motor 171 may be transferred to the detergent pump driving shaft inside the detergent pump driving shaft body 12*d*.

A rotation direction of the driving shaft 171*a* of the motor 171, a rotation direction of the pulley 171*b*, a rotation direction of the belt 171*c*, a rotation direction of the pulley 171*d*, and a rotation direction of the detergent pump driving shaft may be the same.

Due to a driving force transferred through engagement (or gear engagement) between the gear 12*f* of the detergent pump driving shaft inside the detergent pump driving shaft body 12*d* and the gear 12*g* of the detergent pump body 12*e*, the pump handle 12*a* of the detergent pump body 12*e* may operate (for example, an up-down reciprocating motion). For example, when the gear 12*g* of the detergent pump body 12*e* rotates, the rotary cam (not shown) installed in the inside of the detergent pump body 12*e* may rotate. When the rotary cam rotates, the pump handle 12*a* of the detergent pump body 12*e* may perform a linear motion (for example, a drop motion or a part of a reciprocating motion).

When the pump handle 12*a* falls, a part 11*e* of a detergent accommodated in the inside of the detergent supply container 11 may be supplied to the detergent mixing tub 13 through the supply path 12*i* of the pump handle 12*a* and the detergent discharging opening 12*h*. A height at which a part 11*e* of a detergent falls from the pump handle 12*a* to the detergent mixing tub 13 may be higher than the height of the detergent mixing tub 13.

An amount of detergent (or, an amount of detergent supplied upon a one-time stroke of the pump handle 12*a* from the highest position to the lowest position) that is supplied one time by automatic pumping may be between 30 ml and 50 ml (or between 30 ml and 100 ml, for example, an amount of detergent that is supplied one time may change). The detergent supply container 11 may accommodate a detergent of 1000 ml. Also, the detergent supply container 11 may accommodate a detergent of 300 ml to 3000 ml. A capacity of the detergent supply container 11 may change according to a size and structure of the washing machine 100.

If the pump handle 12*a* falls to the lowest position, the pump handle 12*a* may move linear (for example, rise) by an elastic member (for example, a spring (not shown)). If the pump handle 12*a* falls to the lowest position, the rotary cam (not shown) may return to its original position or the pump handle 12*a* may move linearly (for example, rise) by the elastic member (for example, a spring (not shown)). If the pump handle 12*a* falls to the lowest position, the pump handle 12*a* may move linearly (for example, rise) by a rotation of the elastic member (for example, a spring (not shown)) and the rotary cam (not shown).

When the detergent motor 171 rotates, the pump handle 12*a* may perform a reciprocating motion (for example, fall and rise). Due to the reciprocating motion (for example, falling and rising) of the pump handle 12*a* according to a continuous rotation of the detergent motor 171, a detergent accommodated in the detergent supply container 11 may continue to be supplied to the detergent mixing tub 13 through the supply path 12*i* of the pump handle 12*a* and the detergent discharging opening 12*h*. When the detergent motor 171 stops rotating, the reciprocating motion (for example, falling and rising) of the pump handle 12*a* may terminate. When the detergent motor 171 stops rotating, the detergent pump 12 may stop supplying a detergent automatically.

When the pump handle 12*a* receives a driving force from the detergent motor 171, the pump handle 12*a* may have difficulties in rotating in the clockwise or counterclockwise direction (for example, the pump handle 12*a* is fixed at a first position 12*a*1 (see FIG. 6A)). When the pump handle 12*a* receives no driving force from the detergent motor 171, the pump handle 12*a* may rotate in the clockwise or counterclockwise direction.

In a rinsing course of laundry after washing, the motor 172 of the softening agent supply unit 20 may operate according to an amount of softening agent (or an amount of softening agent calculated in correspondence to a weight of the laundry) which is to be supplied to the washing tub 103.

A driving force for operating the softening agent pump 22 may be transferred from the motor 172. When the driving shaft 172*a* of the motor 172 rotates, the belt 172*c* contacting the pulley 172*b* coupled with the driving shaft 172*a* may rotate in the same direction.

When the belt 172*c* rotates, the driving force of the motor 172 may be transferred to the pulley 172*d* coupled with the driven shaft. Due to engagement (connection or contact) between the connector guide 172*e* coupled with the driven shaft and the connector 22*c* of the softening agent pump driving shaft body 12*d*, a driving force of the motor 172 may be transferred to the softening agent pump driving shaft inside the softening agent pump driving shaft body 22*d*.

A rotation direction of the driving shaft 172*a* of the motor 172, a rotation direction of the pulley 172*b*, a rotation direction of the belt 172*c*, a rotation direction of the pulley 172*d*, and a rotation direction of the softening agent pump driving shaft may be the same.

Due to a driving force transferred through engagement (or, gear engagement) between the gear 22*f* of the softening agent pump driving shaft inside the softening agent pump driving shaft body 22*d* and the gear 22*g* of the softening agent pump body 22*e*, the pump handle 22*a* of the softening agent pump body 22*e* may operate (for example, an up-down reciprocating motion). For example, when the gear 22*g* of the softening agent pump body 22*e* rotates, the rotary cam (not shown) installed in the inside of the softening agent pump body 22*e* may rotate. When the rotary cam rotates, the pump handle 22*a* connected to the softening agent pump body 22*e* may perform a linear motion (for example, a drop motion or a part of a reciprocating motion).

When the pump handle 22*a* falls, a part 21*e* of a softening agent accommodated in the inside of the softening agent supply container 21 may be supplied to the softening agent mixing tub 23 through the supply path 22*i* of the pump handle 22*a* and the softening agent discharging opening 22*h*. A height at which a part 21*e* of a softening agent falls from the pump handle 22*a* to the softening agent mixing tub 23 may be higher than the softening agent mixing tub 23.

An amount of softening agent (or, an amount of softening agent supplied upon a one-time stroke of the pump handle 22*a* from the highest position to the lowest position) that is supplied one time by automatic pumping may be between 30 ml and 50 ml (or between 30 ml and 100 ml, for example, an amount of softening agent that is supplied one time may change). The softening agent supply container 21 may accommodate a softening agent of 1000 ml. Also, the softening agent supply container 21 may accommodate a softening agent of 300 ml to 3000 ml. A capacity of the softening agent supply container 21 may change according to a size and structure of the washing machine 100.

If the pump handle 22*a* falls to the lowest position, the pump handle 22*a* may move linear (for example, rise) by an elastic member (for example, a spring (not shown)). If the pump handle 22*a* falls to the lowest position, the rotary cam (not shown) may return to its original position, or the pump handle 22*a* may move linearly (for example, rise) by the elastic member (for example, a spring (not shown)). If the pump handle 22*a* falls to the lowest position, the pump handle 22*a* may move linearly (for example, rise) by a rotation of the elastic member (for example, a spring (not shown)) and the rotary cam (not shown).

When the softening agent motor 172 rotates, the pump handle 22*a* may perform a reciprocating motion (for example, fall and rise). Due to the reciprocating motion (for example, falling and rising) of the pump handle 22*a* according to a continuous rotation of the softening agent motor 172, a softening agent accommodated in the softening agent supply container 21 may continue to be supplied to the softening agent mixing tub 23 through the supply path 22*i* of the pump handle 22*a* and the softening agent discharging opening 22*h*. When the softening agent motor 172 stops rotating, the reciprocating motion (for example, falling and rising) of the pump handle 22*a* may terminate. When the softening agent motor 172 stops rotating, the softening agent pump 22 may stop supplying a softening agent automatically.

The motor 171 of the detergent supply unit 10 may operate in correspondence to an amount of detergent calculated by calculating a weight of laundry, under the control of a controller. Also, the motor 172 of the softening agent supply unit 20 may operate in correspondence to an amount of softening agent calculated by calculating the weight of the laundry, under the control of a controller. The motor 171 of the detergent supply unit 10 and/or the motor 172 of the softening agent supply unit 20 may operate sequentially or simultaneously. For example, the motor 171 of the detergent supply unit 10 may operate, and then the motor 172 of the softening agent supply unit 20 may operate, and vice versa.

When the pump handle 22*a* receives a driving force from the softening agent motor 172, the pump handle 22*a* may have difficulties in rotating in the clockwise or counterclockwise direction (for example, the pump handle 22*a* is fixed at a first position 22*a*1 (see FIG. 6A)). When the pump handle 22*a* receives no driving force from the softening agent motor 172, the pump handle 22*a* may rotate in the clockwise or counterclockwise direction.

Referring to FIGS. 5C and 5D showing another embodiment of the present disclosure, when laundry is accommodated in the washing tub 103, and the door 102 covers the opening 101*a* formed in the top 101*c* of the main body 101, the user may perform an input of selecting a washing course (for example, a normal course) and an option (for example, washing time, the number of times of rinsing, etc.).

If a weight of the accommodated laundry is calculated, at least one among an amount of detergent, an amount of softening agent, and an amount of bleach, which are to be supplied to the washing tub 103 may be calculated. If the weight of the accommodated laundry is calculated, the motor 171 of the detergent supply unit 10 may operate according to an amount of detergent which is to be supplied to the washing tub 103.

A driving force for operating the detergent pump 12-1 may be transferred from the motor 171-1. When the gear 12*g*-1 of the detergent pump 12-1 contacting the gear 171*e*-1 coupled with the driving shaft 171*a*-1 of the motor 171-1 rotates, a driving force may be transferred.

The driving force transferred to the inside of the detergent pump body 12*e* through a rotation of the gear 171*e*-1 coupled with the driving shaft 171*a*-1 of the motor 171-1 and a rotation of the detergent pump gear 12*g*-1 may be transferred to the rotary cam (not shown) inside the detergent pump body 12*e*-1.

A rotation direction of the motor driving shaft 171*a*-1 may be different from a rotation direction of the detergent pump gear 12*g*-1.

Due to a driving force transferred through engagement between the gear 171*e*-1 of the motor driving shaft 171-1 and the gear 12*g*-1 of the detergent pump body 12*e*, the pump handle 12*a*-1 of the detergent pump body 12*e*-1 may operate (for example, an (up-down) reciprocating motion). For example, when the gear 12*g*-1 of the detergent pump body 12*e*-1 rotates, the rotary cam (not shown) installed in the inside of the detergent pump body 12*e*-1 may rotate. When the rotary cam rotates, the pump handle 12*a*-1 may perform a linear motion (for example, a drop motion or a part of a reciprocating motion).

When the pump handle 12*a*-1 falls, a part 11*e*-1 of a detergent accommodated in the inside of the detergent supply container 11-1 may be supplied to the detergent mixing tub 13-1 through the detergent supply portion 11*g* connected to the detergent outlet 11*f* formed in the bottom of the detergent supply container 11, the supply path 12*i*-1 of the pump handle 12*a*-1, and the detergent discharging opening 12*h*-1. When the pump handle 12*a*-1 falls, a part 11*e*-1 of a detergent may be supplied to the detergent pump 12-1 through the detergent supply portion 11*g* connected to the detergent outlet 11*f* formed in the bottom of the detergent supply container 11-1. The part of the detergent 11*e*-1 provided to the detergent pump 12-1 may be supplied to the detergent mixing tub 13-1 through the supply path 12*i*-1 formed in the inside of the pump handle 12*a*-1 and the detergent discharging opening 12*h*-1.

A height at which the detergent 11*e*-1 falls from the detergent discharging opening 12*h*-1 of the pump handle 12*a*-1 to the detergent mixing tub 13-1 may be higher than the height of the detergent mixing tub 13-1.

An amount of detergent (or, an amount of detergent supplied upon a one-time stroke of the pump handle 12*a*-1 from the highest position to the lowest position) that is supplied one time by automatic pumping may be between 31 ml and 50 ml (or between 31 ml and 99 ml, for example, an amount of detergent that is supplied one time may change). The detergent supply container 11-1 may accommodate a detergent of 1000 ml. Also, the detergent supply container 11-1 may accommodate a detergent of 300 ml to 3000 ml. A capacity of the detergent supply container 11-1 may change according to a size and structure of the washing machine 100.

If the pump handle 12*a*-1 falls to the lowest position, the pump handle 12*a*-1 may move linear (for example, rise) by the elastic member (for example, a spring (not shown)). If the pump handle 12*a*-1 falls to the lowest position, the rotary cam (not shown) may return to its original position or the pump handle 12*a*-1 may move linearly (for example, rise) by the elastic member (for example, a spring (not shown)). If the pump handle 12*a*-1 falls to the lowest position, the pump handle 12*a*-1 may move linearly (for example, rise) by a rotation of the elastic member (for example, a spring (not shown)) and the rotary cam (not shown).

When the detergent motor 171-1 rotates, the pump handle 12*a*-1 may perform a reciprocating motion (for example, fall and rise). Due to the reciprocating motion (for example, falling and rising) of the pump handle 12*a*-1 according to a continuous rotation of the detergent motor 171-1, a detergent accommodated in the detergent supply container 11-1 may continue to be supplied to the detergent mixing tub 13-1 through the detergent outlet 11*f*, the detergent supply portion 11*g*, the supply path 12*i*-1 of the pump handle 12*a*-1, and the detergent discharging opening 12*h*-1. When the detergent motor 171-1 stops rotating, the reciprocating motion (for example, falling and rising) of the pump handle 12*a*-1 may terminate. When the detergent motor 171 stops rotating, the detergent pump 12-1 may stop supplying a detergent automatically.

When the pump handle 12*a*-1 receives a driving force from the detergent motor 171-1, the pump handle 12*a*-1 may have difficulties in rotating in the clockwise or counterclockwise direction (for example, the pump handle 12*a*-1 is maintained at a first position toward the detergent mixing tub 13-1). When the pump handle 12*a*-1 receives no driving force from the detergent motor 171-1, the pump handle 12*a*-1 may rotate in the clockwise or counterclockwise direction.

In a rinsing course of laundry after washing, the motor 172-1 of the softening agent supply unit 20 may operate according to an amount of softening agent (or an amount of softening agent calculated in correspondence to a weight of the laundry) which is to be supplied to the washing tub 103.

A driving force for operating the softening agent pump 22-1 may be transferred from the motor 172-1. When the gear 22*g*-1 of the softening agent pump 22-1 contacting the gear 171*e*-1 coupled with the driving shaft 172*a*-1 of the motor 172-1 rotates, a driving force may be transferred.

The driving force transferred to the inside of the detergent pump body 22*e* through a rotation of the gear 172*e*-1 coupled with the driving shaft 172*a*-1 of the motor 172-1 and a rotation of the softening agent pump gear 22*g*-1 may be transferred to the rotary cam (not shown) inside the softening agent pump body 22*e*-1.

A rotation direction of the motor driving shaft 172*a*-1 may be different from a rotation direction of the softening agent pump gear 22*g*-1.

Due to a driving force transferred through engagement between the gear 172*e*-1 of the motor driving shaft 172*a*-1 and the gear 22*g*-1 of the softening agent pump body 22*e*, the pump handle 22*a*-1 of the softening agent pump body 22*e*-1 may operate (for example, a (up-down) reciprocating motion). For example, when the gear 22*g*-1 of the softening agent pump body 22*e*-1 rotates, the rotary cam (not shown) installed in the inside of the softening agent pump body 22*e*-1 may rotate. When the rotary cam rotates, the pump handle 22*a*-1 may perform a linear motion (for example, a drop motion or a part of a reciprocating motion).

When the pump handle 22*a*-1 falls, a part 21*e*-1 of a softening agent accommodated in the inside of the detergent supply container 21-1 may be supplied to the softening agent mixing tub 23-1 through the softening agent supply portion 21*g* connected to the detergent outlet 21*f* formed in the bottom of the softening agent supply container 21-1, the supply path 22*i*-1 of the pump handle 22*a*-1, and the softening agent discharging opening 22*h*-1. When the pump handle 22*a*-1 falls, a part 21*e*-1 of a softening agent may be supplied to the softening agent pump 22-1 through the softening agent supply portion 21*g* connected to the softening agent outlet 21*f* formed in the bottom of the softening agent supply container 21-1. The part of the softening agent 21*e*-1 provided to the softening agent pump 22-1 may be supplied to the softening agent mixing tub 23-1 through the supply path 22*i*-1 formed in the inside of the pump handle 22*a*-1 and the softening agent discharging opening 22*h*-1.

A height at which a softening agent 21*e*-1 falls from the softening agent discharging opening 22*h*-1 of the pump handle 22*a*-1 to the softening agent mixing tub 23 may be higher than the height of the softening agent mixing tub 23-1.

An amount of softening agent (or, an amount of softening agent supplied upon a one-time stroke of the pump handle 22*a*-1 from the highest position to the lowest position) that is supplied one time by automatic pumping may be between 31 ml and 50 ml (or between 31 ml and 99 ml, for example, an amount of softening agent that is supplied one time may change). The softening agent supply container 21-1 may accommodate a softening agent of 1000 ml. Also, the softening agent supply container 21-1 may accommodate a softening agent of 300 ml to 3000 ml. A capacity of the softening agent supply container 21-1 may change according to a size and structure of the washing machine 100.

If the pump handle 22*a*-1 falls to the lowest position, the pump handle 22*a*-1 may move linear (for example, rise) by an elastic member (for example, a spring (not shown)). If the pump handle 22*a*-1 falls to the lowest position, the rotary cam (not shown) may return to its original position, or the pump handle 22*a*-1 may move linearly (for example, rise) by the elastic member (for example, a spring (not shown)). If the pump handle 22*a*-1 falls to the lowest position, the pump handle 22*a*-1 may move linearly (for example, rise) by a rotation of the elastic member (for example, a spring (not shown)) and the rotary cam (not shown).

When the softening agent motor 172-1 rotates, the pump handle 22*a*-1 may perform a reciprocating motion (for example, fall and rise). Due to the reciprocating motion (for example, falling and rising) of the pump handle 22*a*-1 according to a continuous rotation of the softening agent motor 172-1, a softening agent accommodated in the softening agent supply container 21-1 may continue to be supplied to the softening agent mixing tub 23-1 through the softening agent outlet 21*f*, the softening agent supply portion 21*g*, the supply path 22*i*-1 of the pump handle 22*a*-1, and the softening agent discharging opening 22*h*-1. When the softening agent motor 172-1 stops rotating, the reciprocating motion (for example, falling and rising) of the pump handle 22*a*-1 may terminate. When the softening agent motor 172-1 stops rotating, the softening agent pump 22-1 may stop supplying a softening agent automatically.

When the pump handle 22*a*-1 receives a driving force from the softening agent 172-1, the pump handle 22*a*-1 may have difficulties in rotating in the clockwise or counterclockwise direction (for example, the pump handle 22*a*-1 is fixed at the first position toward the softening agent mixing tub 23-1). When the pump handle 22*a*-1 receives no driving force from the softening agent motor 172-1, the pump handle 22*a*-1 may rotate in the clockwise or counterclockwise direction.

Figure 6A:
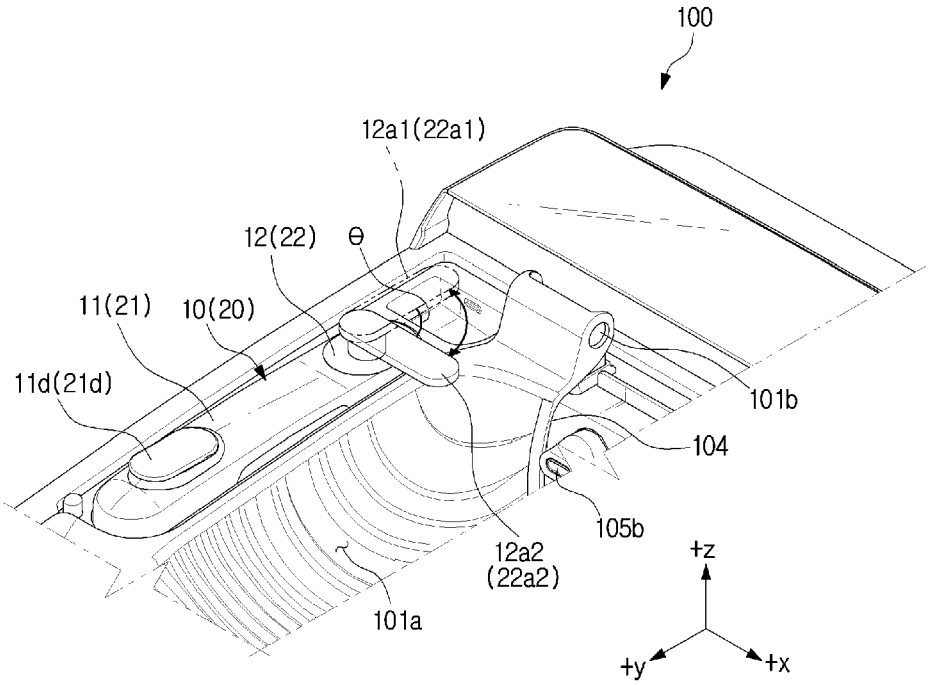
FIGS. 6A and 6B are schematic perspective views showing a detergent supply unit for supplying a detergent manually, according to another embodiment of the present disclosure.
Figure 6B:
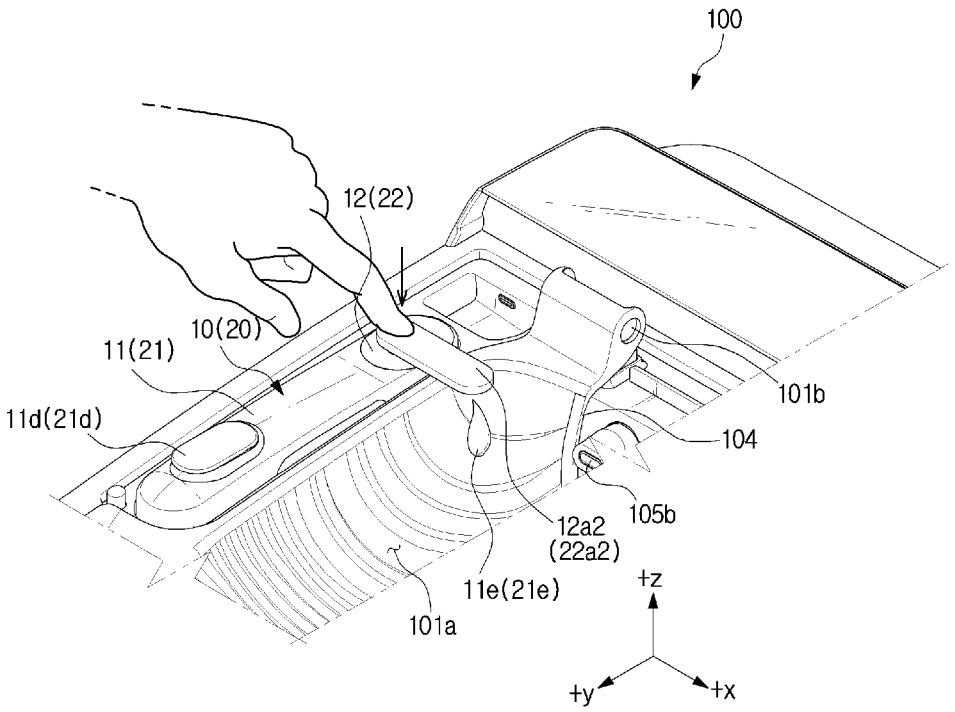

FIGS. 6A and 6B are schematic perspective views showing a detergent supply unit for supplying a detergent manually, according to another embodiment of the present disclosure.

Referring to FIGS. 6A and 6B showing another embodiment of the present disclosure, a user may supply a detergent (or a softening agent) manually to the washing tub 103.

In FIGS. 6A and 6B, the door 102 may be in an open state, and the additional door 104 may cover the opening 101*a*. If the door 102 opens, the user can supply a detergent (or a softening agent) manually to the additional door 104. If the door 102 opens, it may be difficult that the washing machine 100 supplies a detergent (or a softening agent) through automatic pumping. The following description relates to a case of manually supplying a detergent through the detergent supply unit 10, and the following description can be applied in the same manner to the softening agent supply unit 20 corresponding to the detergent supply unit 10.

When the door 102 opens, and the additional door 104 covers the opening 101*a*, washing water may be supplied from the water supply unit 141 to the additional door 104 accommodating laundry through the additional water supply opening 105*b*.

The user may change (or rotate) the pump handle 12*a* of the detergent supply unit 10 from a first position 12*a*1 to a second position 12*a*2. The second position 12*a*2 of the pump handle 12*a* may be a position at which the user can supply a detergent manually to the additional door 104. For example, a change angle θ between the first position 12*a*1 and the second position 12*a*2 may be within an angle range of 30° to 110°. Also, the change angle θ may be within an angle range of 37° to 151°.

The position (for example, the first position 12*a*1) of the pump handle 12*a* when it performs automatic pumping by a driving force from the motor 171 may be different from the position (for example, the second position 12*a*2) of the pump handle 12*a* when it performs manual pumping by a user.

When the pump handle 12*a* is at the second position 12*a*2, or when the pump handle 12*a* is positioned within the change range θ, the user can apply pressure to the pump handle 12*a*. The pump handle 12*a* may operate (for example, a (up-down) reciprocating motion) by the pressure. If the pump handle 12*a* falls downward, a part 11*e* of the detergent contained in the detergent supply container 11 may be supplied to the additional door 104. An amount of detergent that is supplied one time by manual pumping may be between 40 ml and 50 ml (for example, an amount of detergent that is supplied one time may change).

The user may change (or rotate) the pump handle 22*a* of the softening agent supply unit 20 from a first position 22*a*1 to a second position 22*a*2. The second position 22*a*2 of the pump handle 22*a* may be a position at which the user can supply a softening agent manually to the additional door 104. For example, a change angle θ between the first position 22*a*1 and the second position 22*a*2 may be within an angle range of 30° to 110°. Also, the change angle θ may be within an angle range of 37° to 151°.

When the pump handle 22*a* is at the second position 22*a*2, or when the pump handle 22*a* is positioned within the change range θ, the user can apply pressure to the pump handle 22*a*. The pump handle 22*a* may operate (for example, a (up-down) reciprocating motion) by the pressure. If the pump handle 22*a* falls downward, a part 21*e* of the softening agent contained in the softening agent supply container 21 may be supplied to the additional door 104. An amount of softening agent that is supplied one time by manual pumping may be between 40 ml and 50 ml (for example, an amount of detergent that is supplied one time may change).

In another embodiment of the present disclosure, manual supply of detergent through the detergent supply unit 10-1 and manual supply of softening agent through the softening agent supply unit 20-1 may be substantially similar to manual supply of detergent through the detergent supply unit 10 and manual supply of softening agent through the softening agent supply unit 20, as shown in FIGS. 6A and 6B, and accordingly, detailed descriptions thereof will be omitted.

In the other embodiment of the present disclosure, the user may press (or manually pump) the pump handle 12*a* at the first position 12*a*1 in the detergent supply unit 10 to supply a detergent to the detergent mixing tub 13. The user may supply a detergent additionally to the detergent mixing tub 13 by manually pumping the pump handle 12*a* positioned at the first position 12*a*1. Also, the user may press (manually pump) the pump handle 22*a* of the softening agent supply unit 20, positioned at the first position 22*a*1, to supply a softening agent to the softening agent mixing tub 23. The user may additionally supply a softening agent to the softening agent mixing tub 23 by manually pumping the pump handle 22*a* positioned at the first position 22*a*1.

Figure 7A:
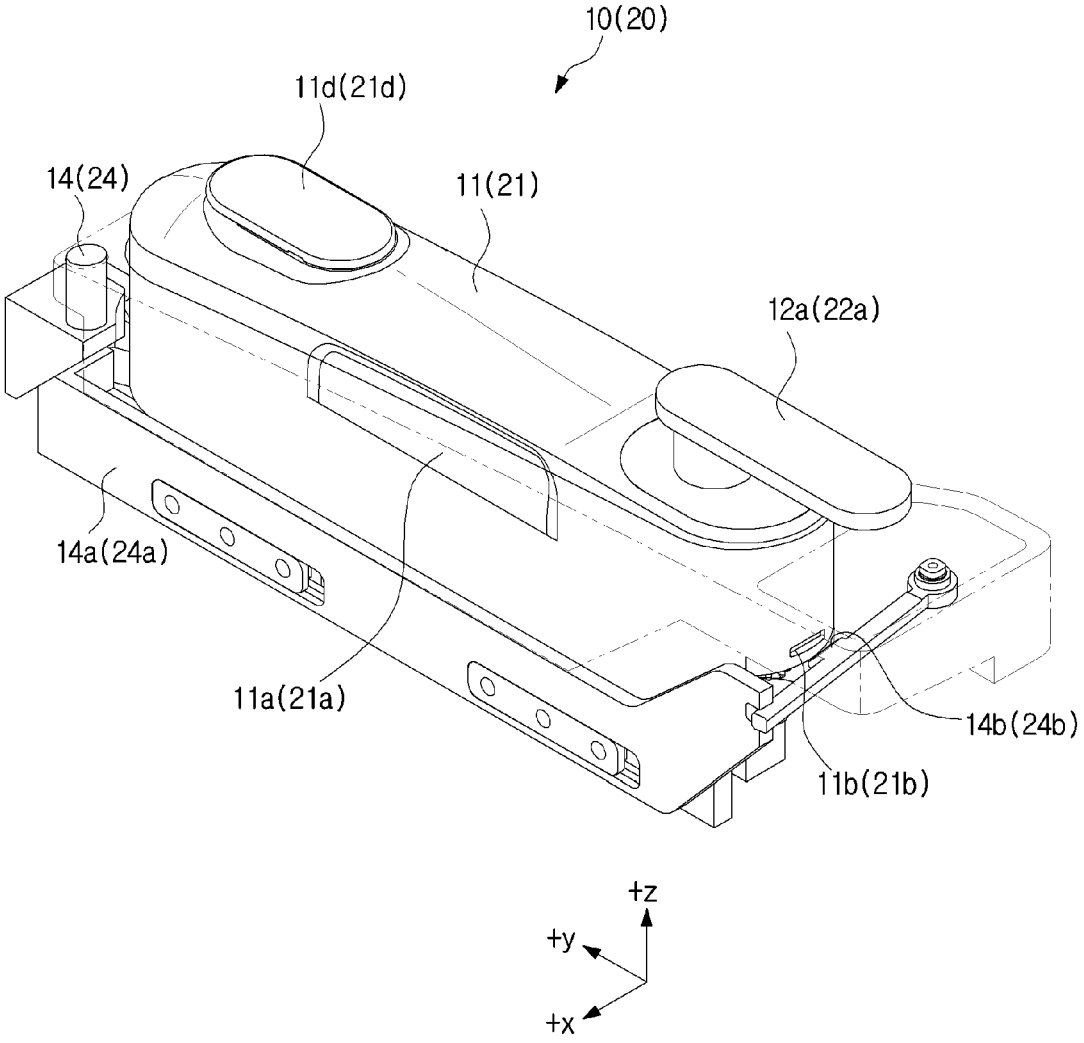
FIGS. 7A and 7B are schematic perspective views for describing operation of separating a detergent supply container from a detergent supply unit, according to an embodiment of the present disclosure.
Figure 7B:
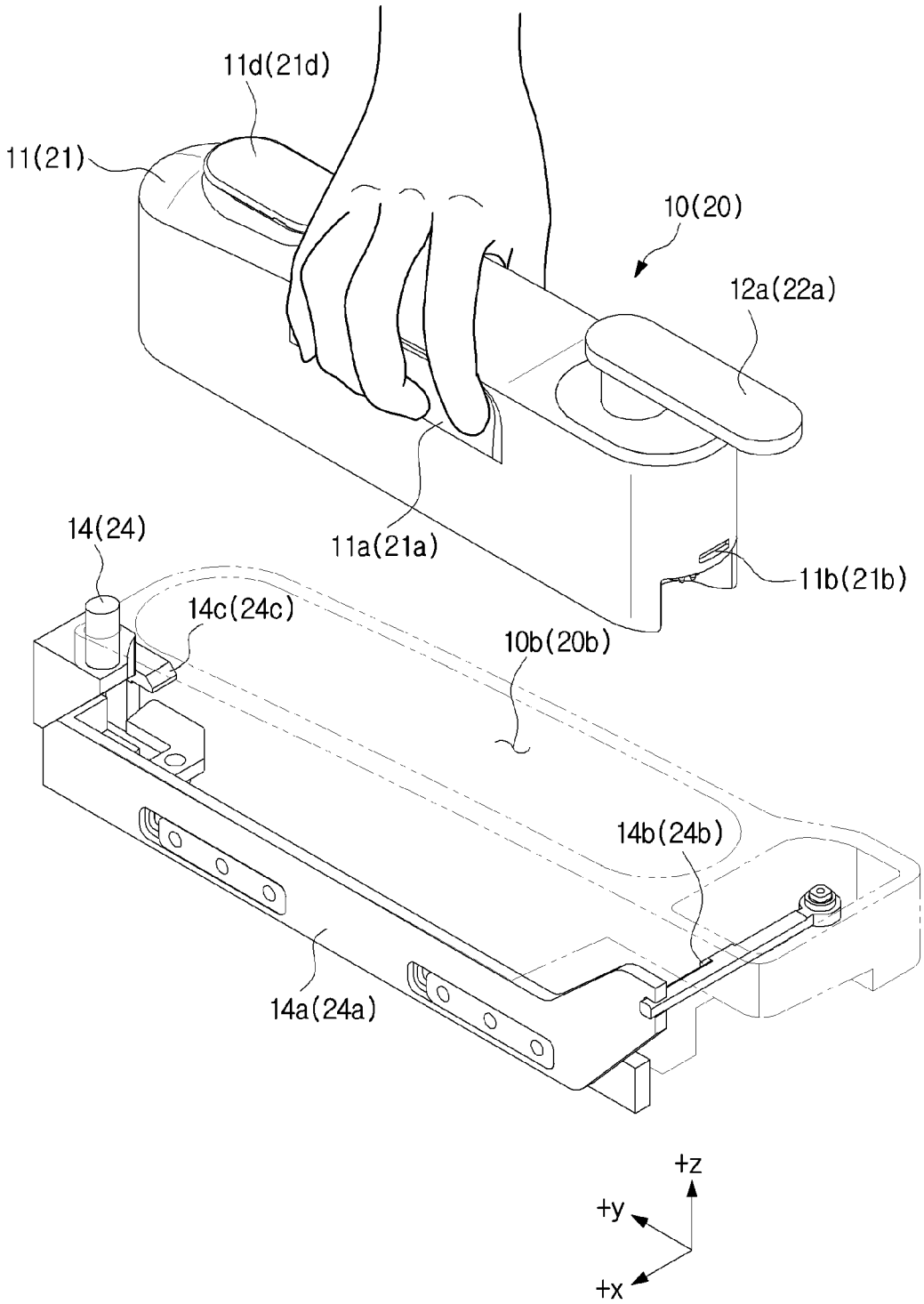
Figure 7C:
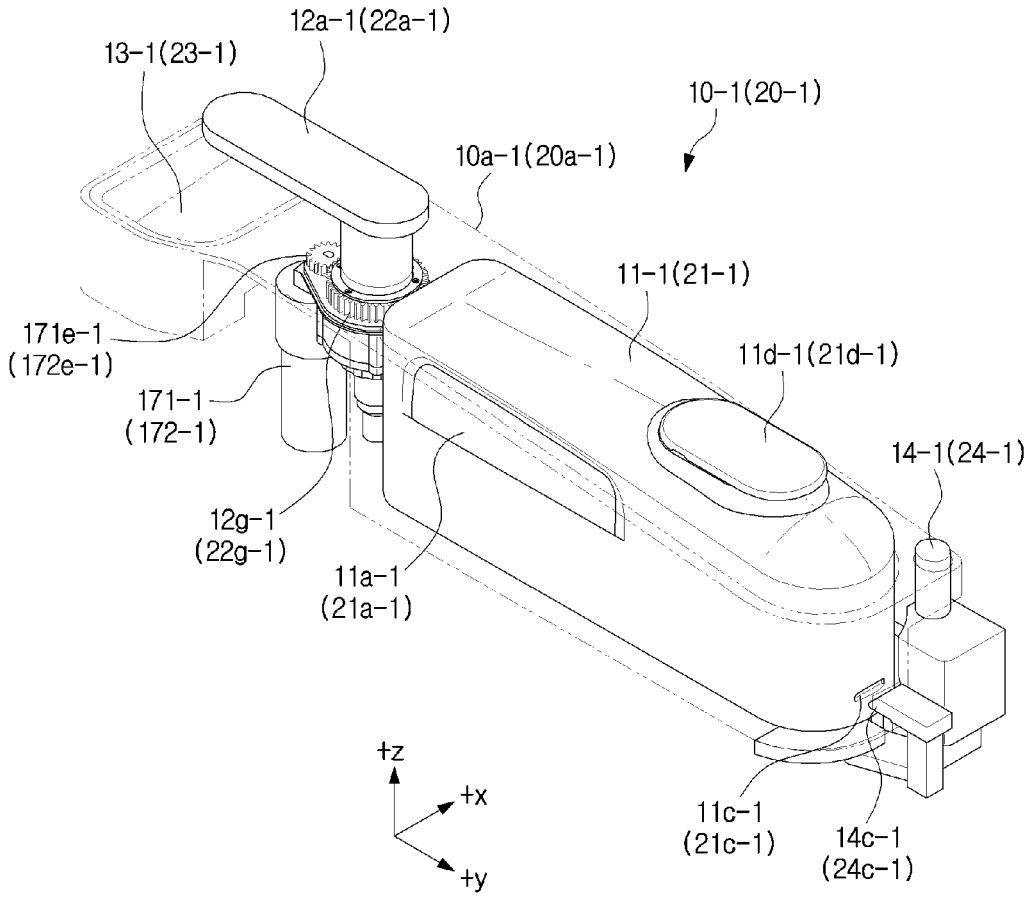
FIGS. 7C and 7D are schematic perspective views for describing operation of separating a detergent supply container from a detergent supply unit, according to an embodiment of the present disclosure.
Figure 7D:
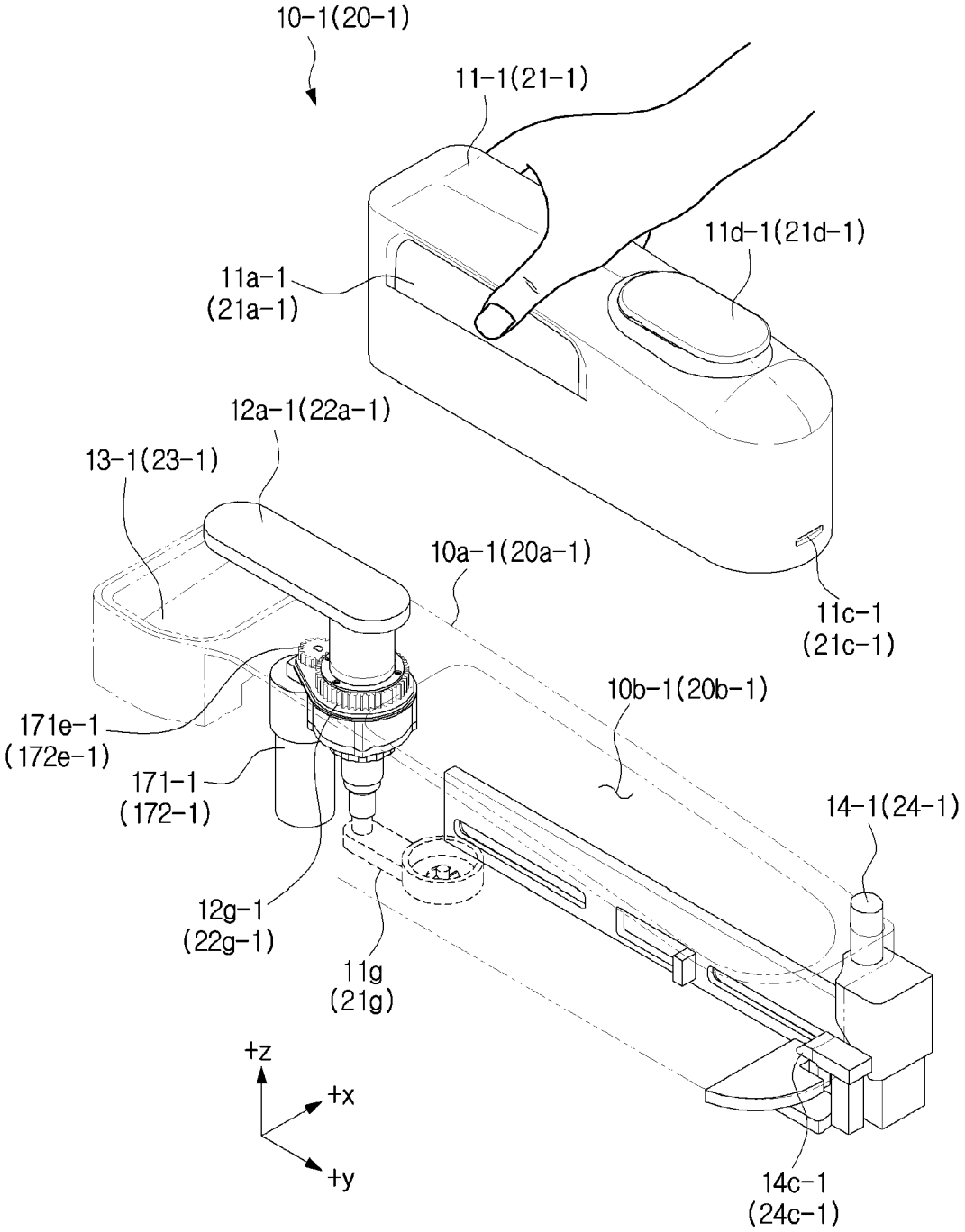

FIGS. 7A and 7B are schematic perspective views for describing operation of separating a detergent supply container from a detergent supply unit, according to an embodiment of the present disclosure. FIGS. 7C and 7D are schematic perspective views for describing operation of separating a detergent supply container from a detergent supply unit, according to an embodiment of the present disclosure.

Referring to FIGS. 7A and 7B, the detergent supply container 11 may be separated from the detergent supply unit 10. When a detergent is added in the detergent supply container 11, or when the detergent supply container 11 is cleaned, the user may separate the detergent supply container 11 from the detergent supply unit 10.

When the user presses the release button 14, the detergent supply container 11 accommodated in the accommodating portion 10*b* of the detergent supply unit 10 may be separated from the detergent supply unit 10. When the user presses the release button 14, the release link 14*a* elastically supported may move. Also, when the user presses the release button 14, the protrusion 14*c* may move. Also, if the release link 14*a* moves, and accordingly the protrusion 14*b* rotates in the counterclockwise direction, the catching portion 11*b* of the detergent supply container 11 may be spaced apart from the protrusion 14*b*.

The elastic member (for example, a spring, not shown) may be located on the bottom of the accommodating portion 10*b*. If the catching portion 11*b* of the detergent supply container 11 is spaced apart from the protrusion 14*b*, an elastic force may be applied upward from the detergent supply container 11 by the elastic member (not shown) located on the bottom of the accommodating portion 10*b*.

Due to the elastic force applied upward, when the user grips the groove 11*a* of the detergent supply container 11 to lift the detergent supply container 11, the detergent supply container 11 may be separated from the detergent supply unit 10.

The detergent supply container 11 may be installed in the accommodating portion 10*b* of the detergent supply unit 10 in reverse of the order in which the detergent supply container 11 is separated from the detergent supply unit 10. For example, if the detergent supply container 11 is put in the accommodating portion 10*b* of the detergent supply unit 10, and the user applies pressure to the detergent supply container 11, the catching portions 11*b* and 11*c* of the detergent supply container 11 may be coupled with the protrusions 14*b* and 14*c* so that the detergent supply container 11 can be fixed in the accommodating portion 10*b* of the detergent supply unit 10.

The softening agent supply container 21 may be separated from the softening agent supply unit 20. When a softening agent is added in the softening agent supply container 21, or when the softening agent supply container 21 is cleaned, the user may separate the softening agent supply container 21 from the softening agent supply unit 20.

When the user presses the release button 24, the softening agent supply container 21 accommodated in the accommodating portion 20*b* of the softening agent supply unit 20 may be separated from the softening agent supply unit 20. When the user presses the release button 24, the release link 24*a* elastically supported may move. Also, when the user presses the release button 24, the protrusion 24*c* may move. Also, if the release link 24*a* moves, and accordingly the protrusion

24*b* rotates in the counterclockwise direction, the catching portion 21*b* of the softening agent supply container 21 may be spaced apart from the protrusion 24*b*.

The elastic member (for example, a spring, not shown) may be located on the bottom of the accommodating portion 20*b*. If the catching portion 21*b* of the softening agent supply container 21 is spaced apart from the protrusion 24*b*, an elastic force may be applied upward (for example, in the positive (+) z-axis direction) from the softening agent supply container 21 by the elastic member (for example, a spring, not shown) located on the bottom of the accommodating portion 20*b*.

Due to the elastic force applied upward, when the user grips the groove 21*a* of the softening agent supply container 21 to lift the softening agent supply container 21, the softening agent supply container 21 may be separated from the softening agent supply unit 20.

The softening agent supply container 21 may be installed in the accommodating portion 20*b* of the softening agent supply unit 20 in reverse of the order in which the softening agent supply container 21 is separated from the softening agent supply unit 20. For example, if the softening agent supply container 21 is put in the accommodating portion 20*b* of the softening agent supply unit 20, and the user applies pressure to the softening agent supply container 21, the catching portions 21*b* and 21*c* of the softening agent supply container 21 may be coupled with the protrusions 24*b* and 24*c* so that the softening agent supply container 21 can be fixed in the accommodating portion 20*b* of the softening agent supply unit 20.

Referring to FIGS. 7C and 7D showing another embodiment of the present disclosure, the detergent supply container 11-1 may be separated from the detergent supply unit 10-1. When a detergent is added in the detergent supply container 11-1, or when the detergent supply container 11-1 is cleaned, a user may separate the detergent supply container 11-1 from the detergent supply unit 10-1.

When the user presses the release button 14-1, the detergent supply container 11-1 accommodated in the accommodating portion 10*b*-1 of the detergent supply unit 10-1 may be separated from the detergent supply unit 10-1. When the user presses the release button 14-1, the release link 14*a*-1 elastically supported may move. Also, when the user presses the release button 14-1, the protrusion 14*c*-1 may move.

The elastic member (for example, a spring, not shown) may be located on the bottom of the accommodating portion 10*b*-1. If the catching portion 11*c*-1 of the detergent supply container 11-1 is spaced apart from the protrusion 14*c*-1, an elastic force may be applied upward (for example, in the positive (+) z-axis direction) from the detergent supply container 11-1 by the elastic member (not shown) located on the bottom of the accommodating portion 10*b*-1.

Due to the elastic force applied upward, when the user grips the groove 11*a*-1 of the detergent supply container 11-1 to lift the detergent supply container 11-1, the detergent supply container 11-1 may be separated from the detergent supply unit 10-1.

The detergent supply container 11-1 may be installed in the accommodating portion 10*b*-1 of the detergent supply unit 10 in reverse of the order in which the detergent supply container 11-1 is separated from the detergent supply unit 10-1. For example, if the detergent supply container 11-1 is put in the accommodating portion 10*b*-1 of the detergent supply unit 10, and the user applies pressure to the detergent supply container 11-1, the catching portion 11*c*-1 of the detergent supply container 11-1 may be coupled with the protrusion 14*c*-1 so that the detergent supply container 11-1 can be fixed in the accommodating portion 10*b*-1 of the detergent supply unit 10-1.

The softening agent supply container 21-1 may be separated from the softening agent supply unit 20-1. When a softening agent is added in the softening agent supply container 21-1, or when the softening agent supply container 21-1 is cleaned, the user may separate the softening agent supply container 21-1 from the softening agent supply unit 20-1.

When the user presses the release button 24-1, the softening agent supply container 21-1 accommodated in the accommodating portion 20*b*-1 of the softening agent supply unit 20-1 may be separated from the softening agent supply unit 20-1. When the user presses the release button 24-1, the release link 24*a*-1 elastically supported may move. Also, when the user presses the release button 24, the protrusion 24*c*-1 may move.

The elastic member (for example, a spring, not shown) may be located on the bottom of the accommodating portion 20*b*-1. If the catching portion 21*c*-1 of the softening agent supply container 21-1 is spaced apart from the protrusion 24*c*-1, an elastic force may be applied upward (for example, a positive (+) z-axis direction) from the softening agent supply container 21-1 by the elastic member (not shown) located on the bottom of the accommodating portion 20*b*-1.

Due to the elastic force applied upward, when the user grips the groove 21*a*-1 of the softening agent supply container 21-1 to lift the softening agent supply container 21-1, the softening agent supply container 21-1 may be separated from the softening agent supply unit 20-1.

The softening agent supply container 21-1 may be installed in the accommodating portion 20*b*-1 of the softening agent supply unit 20-1 in reverse of the order in which the softening agent supply container 21-1 is separated from the softening agent supply unit 20. For example, if the softening agent supply container 21-1 is put in the accommodating portion 20*b*-1 of the softening agent supply unit 20-1, and the user applies pressure to the softening agent supply container 21-1, the catching portion 21*c*-1 of the softening agent supply container 21-1 may be coupled with the protrusion 24*c*-1 so that the softening agent supply container 21-1 can be fixed in the accommodating portion 20*b*-1 of the softening agent supply unit 20-1.

Figure 8:
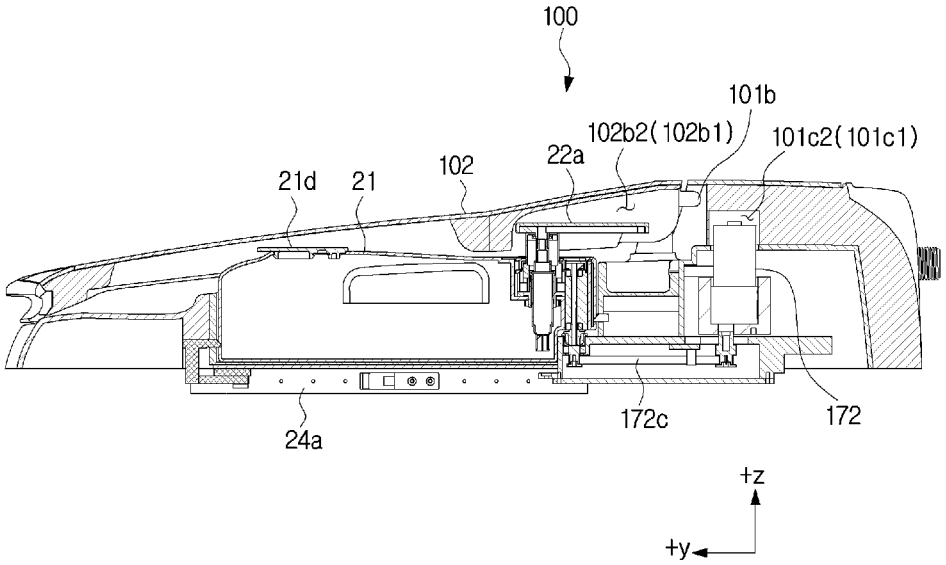
FIG. 8 is a schematic cross-sectional view showing a cover and a detergent supply unit of a washing machine according to an embodiment of the present disclosure.

FIG. 8 is a schematic cross-sectional view showing a cover and a detergent supply unit of a washing machine according to an embodiment of the present disclosure.

FIG. 8 shows a cross-section taken along line A-A of FIG. 2.

When the door 102 is in a closed state, the second handle accommodating portion 102*b*2 accommodating the pump handle 22*a* of the softening agent supply container 21 may be positioned at a corner (for example, in a negative (−) y-axis direction) below the door 102. The second handle accommodating portion 102*b*2 may limit interference between the door 102 and the pump handle 22*a* performing a reciprocating motion. The second handle accommodating portion 102*b*2 of the door 102 in the close state may limit interference between the door 102 and the pump handle 22*a* performing a reciprocating motion (for example, in the positive (+)/negative (−) z-axis direction) by a driving force from the motor 172.

A softening agent pump accommodating portion 101*c*2 accommodating one end of the softening agent pump 172 may be located to one side (for example, in a negative (−) y-axis direction) of the second handle accommodating portion 102*b*2 below the top 101*c* of the main body 101.

When the door 102 is closed, the first handle accommodating portion 102*b*1 (see FIG. 1B) accommodating the pump handle 12*a* of the detergent supply container 11 may be disposed at a corner (for example, in the negative (−) y-axis direction) below the door 102.

The first handle accommodating portion 102*b*1 may limit interference between the door 102 and the pump handle 12*a* performing a reciprocating motion. The first handle accommodating portion 102*b*1 of the door 102 in the closed state may limit interference between the door 102 and the pump handle 12*a* performing a reciprocating motion (for example, in the positive (+)/negative (−) z-axis direction) by a driving force from the motor 171.

A detergent pump accommodating portion 101*c*1 accommodating one end of the detergent pump 171 may be located to one side (for example, in the negative (−) y-axis direction) of the first handle accommodating portion 102*b*1, below the top 101*c* of the main body 101.

The softening agent supply unit 20 described above with reference to FIG. 8 is the substantially same as the detergent supply unit 10, and accordingly, detailed descriptions thereof will be omitted.

In the other embodiment, the detergent supply unit 10 shown in FIG. 8 is substantially similar to the detergent supply unit 10-1 of FIGS. 5C and 5D, and accordingly, detailed descriptions thereof will be omitted. The softening agent supply unit 20 shown in FIG. 8 is substantially similar to the softening agent supply unit 20-1 of FIGS. 5C and 5D, and accordingly, detailed descriptions thereof will be omitted.

Figure 9:
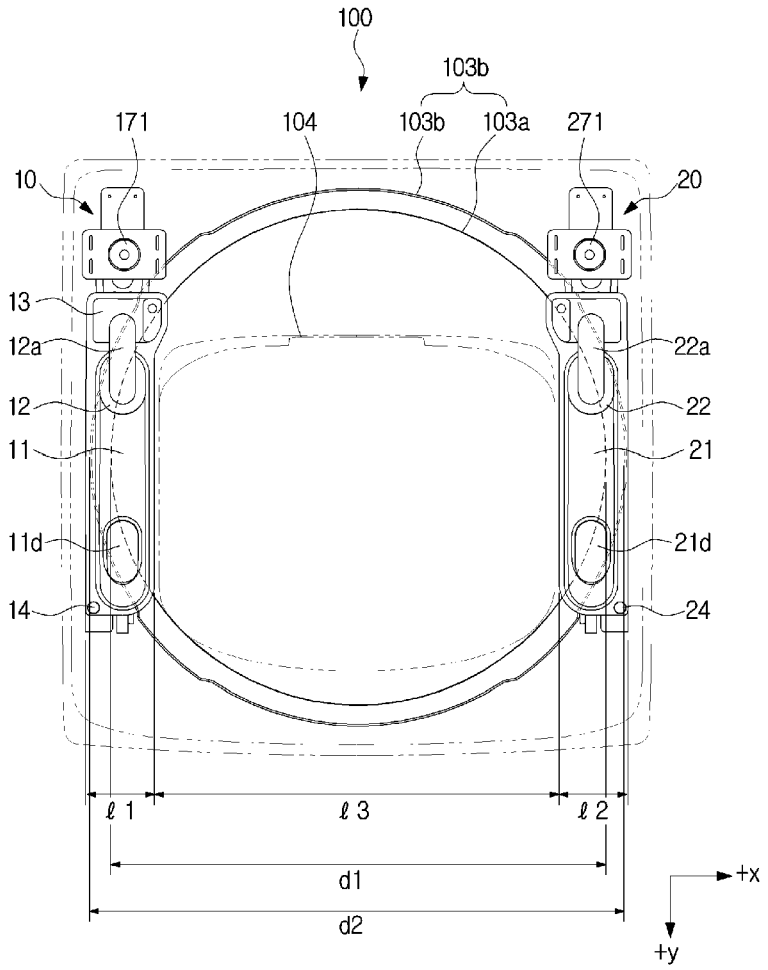
FIG. 9 is a schematic top view showing arrangement of a detergent supply unit, a softening agent supply unit, and a washing tub, according to an embodiment of the present disclosure.

FIG. 9 is a schematic top view showing arrangement of a detergent supply unit, a softening agent supply unit, and a washing tub, according to an embodiment of the present disclosure.

Referring to FIG. 9, the detergent supply unit 10, the softening agent supply unit 20, and the washing tub 103 are shown. The detergent supply unit 10 and the softening agent supply unit 20 may be respectively disposed at both sides of the top 101*c* of the main body 101. The detergent supply unit 10 and the softening agent supply unit 20 may be respectively disposed along a circumferential direction of the washing tub 103. The detergent supply unit 10 and the softening agent supply unit 20 may be respectively disposed at both sides of the main body 101 corresponding to the circumferential direction of the washing tub 103.

The position of the detergent supply unit 10 and the position of the softening agent supply unit 20 may overlap with the washing tub 103. A length 11 of the detergent supply unit 10 may be the same as or different from a length 12 of the softening agent supply unit 20.

An interval 13 between the detergent supply unit 10 and the softening agent supply unit 20 may be smaller than a diameter d1 of the rotating tub 103*a*. A part of the detergent supply unit 10 may overlap with the rotating tub 103*a*. Also, a part of the softening agent supply unit 20 may overlap with the rotating tub 103*a*.

The additional door 104 may be disposed in the interval 13 between the detergent supply unit 10 and the softening agent supply unit 20. The interval 13 between the detergent supply unit 10 and the softening agent supply unit 20 may be longer with a width of the additional door 104.

The interval 13 between the detergent supply unit 10 and the softening agent supply unit 20 may be smaller than a diameter d2 of the tub 103*b*. A part of the detergent supply unit 10 may overlap with the tub 103*b*. Also, a part of the softening agent supply unit 20 may overlap with the tub 103*b*.

At least one of the width 11 of the detergent supply unit 10 and the width 12 of the softening agent supply unit 20 may be greater than a difference (d2−d1) between the diameter d2 of the tub 103*b* and the diameter d1 of the rotating tub 103*a*.

A width of the detergent supply container 10-1 according to another embodiment of the present disclosure as shown in FIGS. 4C and 4D may be identical to or different from the width 11 of the detergent supply container 10 of FIG. 9. Also, the width of the softening agent supply container 20-1 of FIGS. 4C and 4D may be identical to or different from the width 12 of the softening agent supply container 20 of FIG. 9.

Figure 10:
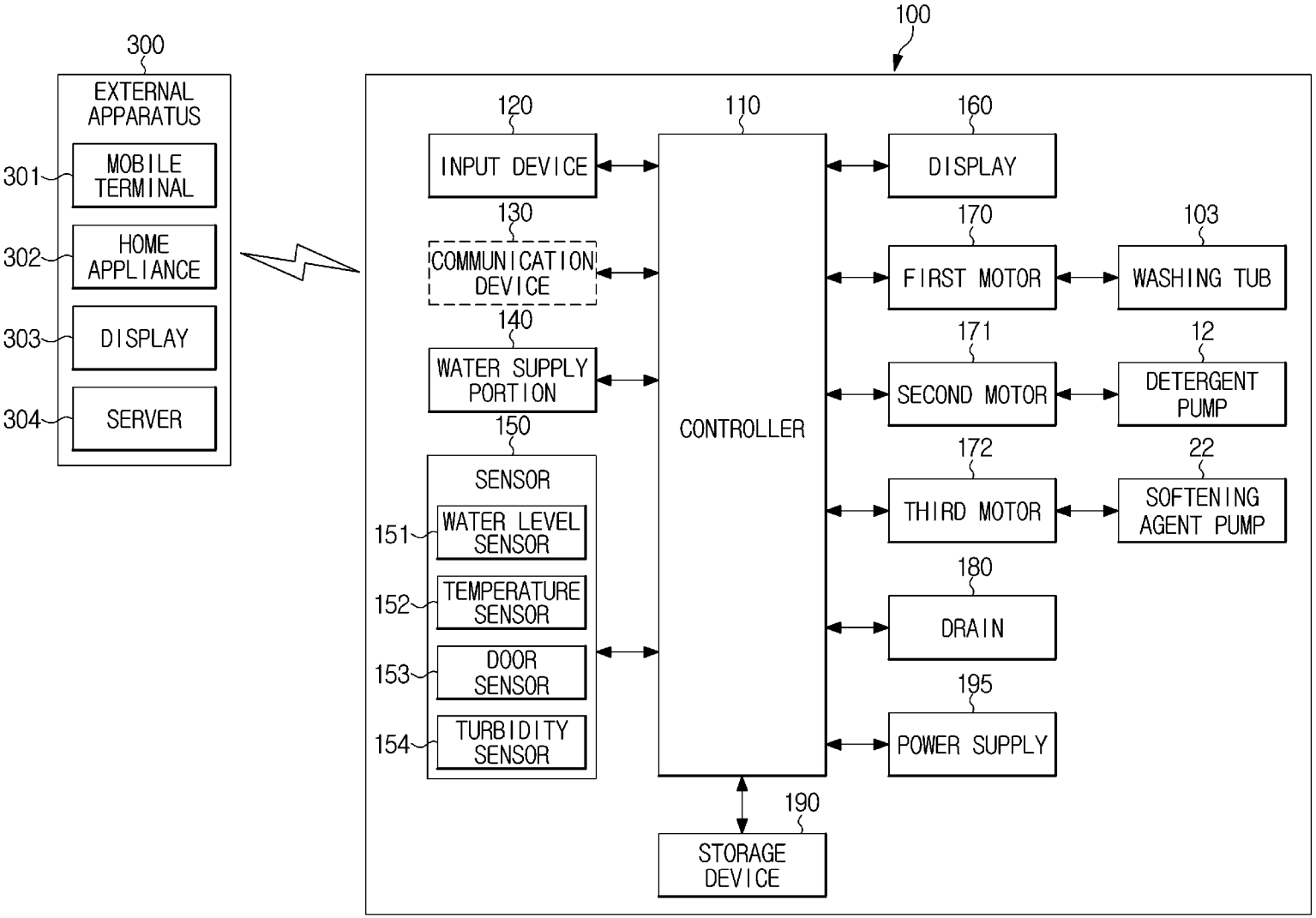
FIG. 10 is a schematic block diagram showing a washing machine according to an embodiment of the present disclosure.

FIG. 10 is a schematic block diagram showing a washing machine according to an embodiment of the present disclosure. The following description about the detergent supply unit 10 of FIG. 10 can be applied in a substantially similar manner to the detergent supply unit 10-1 according to another embodiment of the present disclosure. Also, the following description about the softening agent supply unit 20 can be applied in a substantially similar manner to the softening agent supply unit 20-1 according to another embodiment of the present disclosure.

Referring to FIG. 10, the washing machine 100 may be functionally connected to an external apparatus 300 through a communication device 130. The external apparatus 300 may be a mobile terminal 301 such as a smart phone, a home appliance 302 such as a refrigerator, a display 303 such as a television (TV), or a server 304.

The washing machine 100 may transmit operation (for example, a washing course or an option) information of the washing machine 100, or state (for example, normal or abnormal) information of the washing machine 100 to an external apparatus through the communication device 130, or may receive control information (for example, a control command corresponding to power on/off of the washing machine 100) from the outside through the communication device 130.

The washing machine 100 may include a controller 110, an input device 120, a communication device 130, a water supply portion 140, a sensor 150, a display 160, a motor 170, a drain 180, a storage device 190, and a power supply 195.

The controller 110 may control operations of the washing machine 100. The controller 110 may include a processor (not shown). Also, the controller 110 may include Read Only Memory (ROM, not shown) storing control programs for controlling the washing machine 100, and Random Access Memory (RAM, not shown) used as a storage area for control information received from the outside of the washing machine 100, operation information of the washing machine 100, or state information of the washing machine 100.

The controller 110 may control operations of the motor 171 of the detergent supply unit 10. For example, the controller 110 may output an electrical signal corresponding to operation (for example, rotation, stop, or power on/off) of the motor 171 of the detergent supply unit 10 to the motor 171. The controller 110 may control operations of the motor 172 of the softening agent supply unit 20. For example, the controller 110 may output an electrical signal corresponding to operation (for example, rotation, stop, or power on/off) of the motor 172 of the softening agent supply unit 20 to the motor 172.

The controller 110 may control operations of the washing machine 100 and signal flow between internal components 120 to 190, and process data. The controller 110 may collect operation information of the washing machine 100, and detect a state of the washing machine 100 using the sensor 150. The controller 110 may control power supply of the internal components 110 to 195 using the power supply 195.

The processor (not shown), the ROM (not shown), and the RAM (not shown) may be connected to one another. The processor (not shown), the ROM (not shown), and the RAM (not shown) may be a built-in type or a System On Chip type.

The controller 110 may control the input device 120, the communication device 130, the water supply portion 140, the sensor 150, the display 160, the motor 170, the drain 180, the storage device 190, and the power supply 195.

The term "controller of the washing machine" may be a meaning including a processor (not shown), ROM (not shown), and RAM (not shown). Also, the "controller of the washing machine" may mean a processor.

The input device 120 may receive a user input (for example, power on/off operation, a washing course, or an option). The input device 120 may output an electrical signal corresponding to the user input to the controller 110. The input device 120 may be located on the top of the door 102, or on the top 101*c* of the main body 101.

The communication device 130 may be connected to the external device 300 or a network through a communication network using one or more antennas, under the control of the controller 110. The communication device 130 may transmit operation (for example, a washing course or an option) information of the washing machine 100, or state (for example, normal or abnormal) information of the washing machine to the outside, under the control of the controller 110. Also, the communication device 130 may receive control information (for example, a control command corresponding to power on/off of the washing machine 100) from the outside under the control of the controller 110.

The communication device 130 may include a Wireless Local Area Network (WLAN) communication device, a short-range communication device, or a mobile communication device. The WLAN communication device may support, for example, Wireless-Fidelity (Wi-Fi) communication. The short-range communication device may include, for example, Bluetooth communication, Bluetooth low energy, Infrared Data Association (IrDA), Ultra-Wideband (UWB) communication, and/or Near Field Communication (NFC). The mobile communication device may be connected to the external device 300 through a mobile communication network using one or more antennas, under the control of the controller 110.

The water supply portion 140 may supply washing water to the washing tub 103 or the additional door 104 under the control of the controller 100. The water supply portion 140 may supply washing water to the detergent mixing tub 13 or the softening agent mixing tub 23.

The sensor 150 may detect an operation and/or state of the washing machine 100. The sensor 150 may output an electrical signal corresponding to the detected operation and/or state of the washing machine 100 to the controller 110.

A water level sensor 151 may detect a water level of washing water (or, detergent mixed water, softening agent mixed water, detergent-softening agent mixed water, detergent-softening agent-bleach mixed water, etc.) accommodated in the washing tub 103. The water level sensor 151 may be an electric water level sensor or a mechanical water level sensor.

A temperature sensor 152 may detect temperature of washing water supplied through the water supply unit 141.

A door sensor 153 may detect opening/closing of the door 102.

A turbidity sensor 154 may measure a degree of contamination of washing water accommodated in the washing tub 103. Any one(s) of the above-mentioned sensors 150 may be omitted or modified according to the performance and structure of the washing machine 100, or another sensor(s) may be added according to the performance and structure of the washing machine 100.

The display 160 may display information about an operation and state of the washing machine 100.

The motors 170 to 172 may provide a driving force. The motor 170 (also, referred to as a first motor 170) may rotate the washing tub 103 and the pulsator (not shown) under the control of the controller 110. The motor 171 (also, referred to as a second motor 171) may drive the detergent pump 12 under the control of the controller 110 to supply a detergent automatically. The motor 172 (also, referred to as a third motor 172) may drive the softening agent pump 22 under the control of the controller 110 to supply a softening agent automatically.

The drain 180 may discharge contaminated washing water (or washing water) accommodated in the inside of the washing tub 103 to the outside of the washing machine 100.

The storage device 190 may store signals or data that is input/output to correspond to operations (or states) of the components 110 to 195 under the control of the controller 110. The storage device 190 may store control programs for controlling the washing machine 100 or the controller 110. The storage device 190 may store control information received from the external device 300, information corresponding to an electrical signal received from the input device 120, information corresponding to an electrical signal received from the sensor 150, operation information of the washing machine 100, or state information of the washing machine 100.

The power supply 195 may supply power to the components 110 to 195 of the washing machine 100 under the control of the controller 110.

It will be easily understood to those skilled in the art that any one(s) the components of the washing machine 100 shown in FIG. 10 can be omitted or modified in correspondence to the performance of the washing machine 100, or another component(s) can be added in correspondence to the performance of the washing machine 100.

Figure 11:
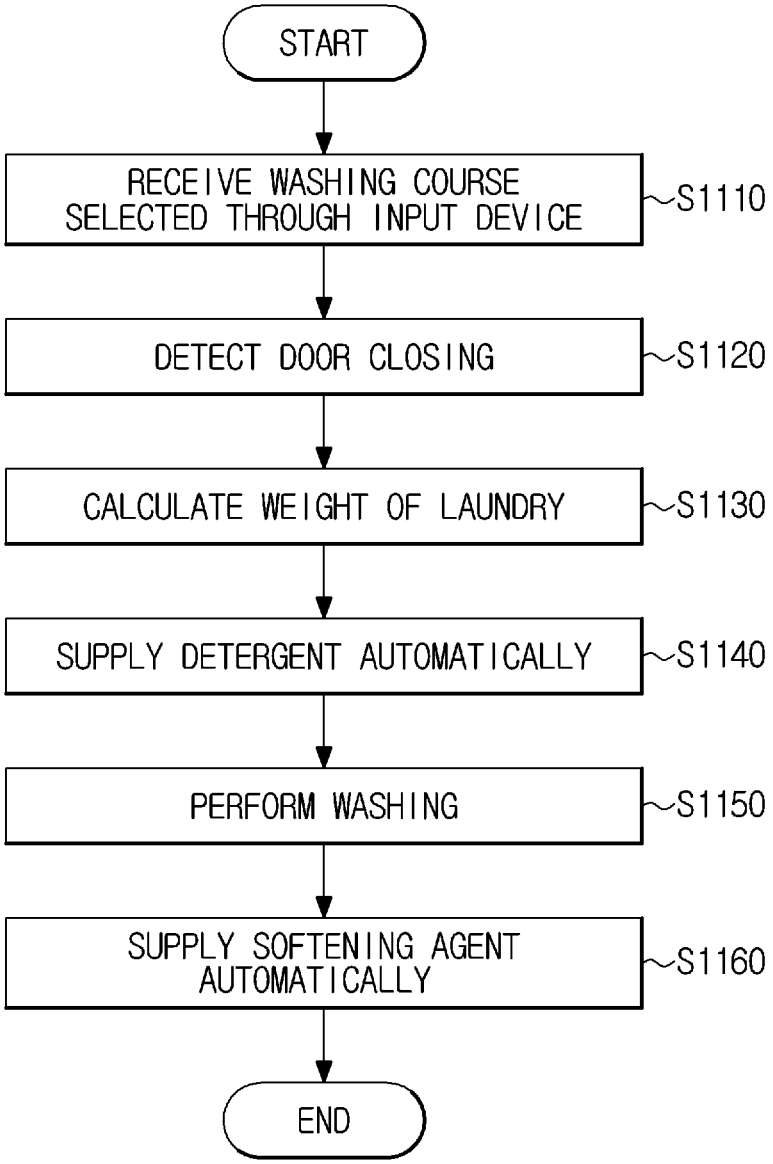
FIG. 11 is a flowchart showing a control method of a washing machine according to an embodiment of the present disclosure.

FIG. 11 is a flowchart showing a control method of a washing machine according to an embodiment of the present disclosure. The following description about the detergent supply unit 10 of FIG. 11 can be applied in a substantially similar manner to the detergent supply unit 10-1 according to another embodiment of the present disclosure. The following description about the softening agent supply unit 20 can be applied in a substantially similar manner to the softening agent supply unit 20-1 according to another embodiment of the present disclosure.

In operation S1110 of FIG. 11, a washing course selected through an input device may be received.

A user may put laundry into the washing tub 103 through the opening 101*a*. The user may close the door 102, and select (or press) the power button of the input device 120. The user may select a washing course (for example, a baby clothes course) through the input device 120. The controller 110 may control a display 600 to display visual information corresponding to the selected washing course.

In operation S1120, door closing may be detected.

When the door 102 is closed, the door sensor 153 may output an electrical signal corresponding to door closing to the controller 110. The controller 110 may detect closing of the door 102 using the electrical signal received from the door sensor 153.

In operation S1130, a weight of the laundry may be calculated.

The controller 110 may drive the motor 170 to rotate the washing tub 103 accommodating the laundry. Before washing water is supplied, the controller 110 may drive the motor 170 to rotate the washing tub 103 accommodating laundry. The controller 110 may calculate a weight of the laundry using at least one of a feedback current value of the motor 170, a height of the laundry accommodated in the washing tub 103, and rotation speed of the rotating tub 103*a*. A technique of calculating a weight of laundry is well-known in the related art, and accordingly, a detailed description thereof will be omitted. The calculated weight may be stored in the storage device 190.

In operation S1140, a detergent may be automatically supplied.

Referring to FIGS. 4A to 5D, the controller 110 may calculate an amount of detergent corresponding to the selected washing course and the calculated weigh of the laundry. The controller 110 may calculate an amount of washing water to dilute the amount of detergent to be supplied according to the selected washing course and the calculated weight of the laundry.

The controller 110 may drive the motor 171 of the detergent supply unit 10 according to the calculated amount of detergent. The detergent supply unit 10 may move the detergent pump 12 reciprocatively using a driving force transferred from the motor 171 to supply a detergent accommodated in the detergent supply container 11 to the detergent mixing tub 13. The controller 110 may control the water supply unit 141 to supply washing water to the detergent mixing tub 13. The washing water may be mixed with the detergent in the detergent mixing tub 13, and the detergent mixed water may be discharged to the washing tub 103 through the outlet 105*a* of the detergent case 105 connected to the detergent mixing tub 13 through the mixed water hose 13*a*.

The controller 110 may control an operation of at least one of the motor 171 and the water supply unit 141 until an amount of supplied detergent reaches the calculated amount of detergent. When an amount of supplied detergent reaches the calculated amount of detergent (or a calculated amount of detergent mixed water), the controller 110 may stop operating the motor 171 and the water supply unit 141.

The controller 110 may control the water supply unit 141 according to the calculated amount of washing water to supply washing water to the washing tub 103 through the outlet 105*a* of the detergent case 105.

According to another embodiment of the present disclosure, the controller 110 may transmit information corresponding to the calculated amount of detergent, the amount of detergent mixed water, or the amount of washing water to the mobile terminal 303 as the external apparatus 300 through the communication device 130. An application capable of displaying the information corresponding to the amount of detergent, the amount of detergent mixed water, or the amount of washing water, transmitted from the washing machine 100, may be executed on the mobile terminal 303. The mobile terminal 303 may recognize an operation state of the detergent pump 12 or an operation state of the mixing tub 30 through the executed application.

In operation S1150, washing may be performed.

When operation of supplying detergent mixed water, softening agent mixed water, or washing water terminates, the controller 110 may drive the motor 170 to perform washing in correspondence to the selected washing course. When washing is performed, a time remaining until washing is completed may be displayed on the display 160. If abnormality is detected in the washing machine 100 when washing is being performed, an abnormal state (for example, too high temperature of water) may be displayed on the display 160. Operation S1140 and operation S1150 may be performed simultaneously or sequentially.

In operation S1160, a softening agent may be automatically supplied.

Referring to FIGS. 4A to 5D, the controller 110 may calculate an amount of softening agent corresponding to the selected washing course and the calculated weight of the laundry. The controller 110 may calculate an amount of washing water to dilute an amount of softening agent to be supplied according to the selected washing course and the calculated weight of the laundry.

The controller 110 may drive the motor 172 of the softening agent supply unit 20 according to the calculated amount of softening agent. The softening agent supply unit 20 may move the softening agent pump 22 reciprocatively using a driving force transferred from the motor 172 to supply a softening agent accommodated in the softening agent supply container 21 to the softening agent mixing tub 23. The controller 110 may control the water supply unit 141 to supply washing water to the softening agent mixing tub 23. The washing water may be mixed with the softening agent in the softening agent mixing tub 23, and the softening agent mixed water may be discharged to the washing tub 103 through the outlet 105*a* of the detergent case 105 connected to the softening agent mixing tub 23 through the mixed water hose 23*a*.

The controller 110 may control an operation of at least one of the motor 172 and the water supply unit 141 until an amount of supplied softening agent reaches the calculated amount of softening agent. When an amount of supplied softening agent reaches the calculated amount of softening agent (or an amount of softening agent mixed water), the controller 110 may stop operating the motor 172 and the water supply unit 141.

The controller 110 may control the water supply unit 141 according to the calculated amount of washing water to supply washing water to the washing tub 103 through the outlet 105*a* of the detergent case 105.

In operation S1160, the softening agent may be automatically supplied, and then the method of controlling the washing machine may terminate.

The methods according to the embodiments of the present disclosure may be implemented in the form of program instructions that can be executed through various computer means, and recorded in computer-readable recording medium. The computer-readable recording medium may also include, alone or in combination with the program instructions, data files, data structures, and the like.

For example, the computer-readable recording medium can be recorded to a volatile or non-volatile storage device such as a Read-Only Memory (ROM) irrespective of deletable or re-recordable, to a memory such as a Random Access Memory (RAM), a memory chip, a memory device, or an integrated circuit, or to a storage medium that is optically or magnetically recordable and readable by a machine (e.g. a computer), such as a Compact Disc (CD), a Digital Video Disc (DVD), a magnetic disk, or a magnetic tape. The storage is an example of a machine-readable storage medium suitable for storing a program or programs including instructions to implement the embodiments of the present invention.

Accordingly, the memory that can be included in the washing machine may be an example of a machine-readable storage medium adapted to store a program or programs including instructions for implementing the embodiments of the present disclosure. The program instructions recorded on the media may be those specially designed and constructed for the present disclosure, or they may be of the kind well-known and available to those having skill in the computer software arts.

While the present disclosure has been particularly described with reference to exemplary embodiments, it should be understood by those of skilled in the art that various changes in form and details may be made without departing from the spirit and scope of the present disclosure.

The invention claimed is:

1. A detergent supply unit comprising:

a housing;

a detergent supply container installable in an accommodating portion of the housing, and configured to accommodate detergent;

a detergent mixing tub formed into the housing and having an opening, a part of the detergent is mixed with water in the detergent mixing tub;

a pump configured to supply the part of the detergent from the detergent supply tub to the detergent mixing tub; and a motor configured to transfer a driving force for driving the pump, wherein the pump comprises a pump handle configured to transmit the driving force from the motor, and a detergent discharging opening, formed at one end of the pump handle to discharge the part of the detergent into the opening of the detergent mixing tub, wherein the pump handle performs a reciprocating motion in an up-down direction by the driving force to discharge the part of the detergent into the opening of the detergent mixing tub while the motor is running, wherein the pump handle is rotatable around the up-down direction so that a position of the detergent discharging opening is changeable between a top of the detergent mixing tub and a top of one side of the detergent mixing tub while the motor is not running.

2. The detergent supply unit of claim 1, wherein the pump further comprises a detergent suction tube configured to suck the part of the detergent from the detergent supply container, and wherein the detergent suction tube is an inside of the detergent supply container.

3. The detergent supply unit of claim 2, wherein the pump handle is couplable with the detergent suction tube, and disposed outside the detergent supply container.

4. The detergent supply unit of claim 1, wherein the pump further comprises a pump driving shaft receiving the driving force from the motor, and wherein a part of the pump driving shaft is exposed to the outside of the detergent supply container.

5. The detergent supply unit of claim 1, wherein the motor further comprises:

a driving shaft transferring the driving force through a belt; and a driven shaft receiving the driving force through the belt, wherein the driving force is transferred to the pump driving shaft through the driven shaft.

6. The detergent supply unit of claim 5, wherein a part of the driven shaft is exposed to the outside, and the part of the driven shaft comprises a connector guide connected to the pump driving shaft.

7. The detergent supply unit of claim 1, wherein the detergent mixing tub receives the water from a water supply unit.

8. The detergent supply unit of claim 7, wherein detergent mixed water mixed in the detergent mixing tub is discharged by a mixed water hose connected to a bottom of the detergent mixing tub.

9. The detergent supply unit of claim 8, wherein the detergent mixed water discharged through the mixed water hose is discharged to the washing tub through a detergent case.

10. The detergent supply unit of claim 1, further comprising:

a protrusion formed in the accommodating portion of the housing;

a catching portion formed in the detergent supply container to correspond to the protrusion; and a release button, wherein when the release button is pressed, the protrusion is spaced apart from the catching portion.

11. The detergent supply unit of claim 1, wherein the detergent accommodated in the detergent supply container is supplied to one of the detergent mixing tub and the washing tub by manual pumping.

* * * * *